United States Patent [19]

Biro

[11] Patent Number: 4,944,118

[45] Date of Patent: Jul. 31, 1990

[54] WELDED WINDOW CONSTRUCTION

[75] Inventor: Alexander J. Biro, Gibsonia, Pa.

[73] Assignee: Chelsea Industries, Inc., Boston, Mass.

[21] Appl. No.: 299,879

[22] Filed: Jan. 19, 1989

[51] Int. Cl.[5] ..... E06B 7/16

[52] U.S. Cl. ..... 49/504; 49/DIG. 2; 52/207

[58] Field of Search ..... 49/501, 504, DIG. 2, 49/404; 52/207, 208

[56] References Cited

U.S. PATENT DOCUMENTS 4,351,131 9/1982 Kubik ..... 49/504

4,555,868 12/1985 Mancuso ..... 49/181

*Primary Examiner*—Kenneth J. Dorner

*Assistant Examiner*—Gerald A. Anderson

*Attorney, Agent, or Firm*—Webb, Burden, Ziesenheim & Webb

[57] ABSTRACT

A sturdy, low profile window having a window frame and at least one sash. The window frame includes a welded master frame and window frame inserts. The window frame inserts in cooperation with the master frame form the window frame. The sash of the low profile window includes a glazing, master sash, and sash inserts. The sash inserts in cooperation with the master sash form the sash and retain the glazing within the sash. The sash of the present invention is confined within the window frame to produce the low profile window.

35 Claims, 10 Drawing Sheets

WELDED WINDOW CONSTRUCTION

BACKGROUND OF THE INVENTION

1. Field of the Invention

The present invention relates to windows. More particularly, the present invention relates to low profile windows comprised of a frame and at least one sash. The frame and sash are constructed from a variety of inserts in cooperation with a common master frame and a common master sash to create various styles of low profile windows.

2. Description of the Prior Art

In a time when fuel costs are rapidly rising the demand for a simpler more energy efficient window is ever present. The energy efficient window desired must confront both the problem of air infiltration and the problem of conduction and radiation of radiant energy through the window from the interior and exterior of the building utilizing the window. It is well known that a well constructed energy efficient window alleviates some of the costs associated with the rising fuel bills. However, it is also widely known that energy efficiency is not the only criteria for the window. The energy efficient window must also provide an acceptable opening as to allow a panoramic view of the outside, allow light and air to enter, and present an aesthetic appearance that is compatible with the architecture of most any building.

There are two major varieties of windows installed in a structural building. A window installed in a structure as the structure is built is called a prime window. A window that is substituted in place of the prime window is called a replacement window. Each type of window may be further classified as either a sliding sash window, casement window, awning window, hopper window, jalousie window, picture window, tilt and turn window or projected window. Even though there are many different types of windows, the sliding sash window and picture window are the most commonly used in the construction industry today.

The sliding sash window may either be a vertical sliding sash window or a horizontal sliding sash window. Both types of windows only allow approximately fifty percent of the window area to open for ventilation purposes because one sash must stack behind the other when the window is open.

The vertical sliding sash window is better known as a double-hung or a single-hung window. The commonly known double-hung window consists mainly of a frame and at least one sash. The frame holds the sashes within the wall of the structure and is comprised of two side jambs, a head, a head adapter, and either a one-part or a two-part bottom called a sill and sill adapter. The common side jambs are the parallel spaced vertical frame members and the head is the top horizontal frame member joining the top of each side jamb. The head and side jambs are typically of equal width. The sill part of the bottom of the window frame slopes downward and away from the exterior of the window frame and has a drip kerf positioned underneath of the sill to prevent water from draining down the exterior of the building. The sill is joined to the horizontal sill adapter such that the sill adapter fits snugly across the bottom of the inside of the window and may project into the interior room of the building.

The sash of the window frame is comprised of a glazing, an upper sash, and a lower sash. Each sash is normally movable within the window frame to form a double-hung window. However, either the upper sash or the lower sash may be fixed within the window frame to form the single-hung window. Each sash consists of upper and lower parallel spaced horizontal sash rails connected at the ends thereof by first and second parallel vertical sash stiles extending therebetween. Typically, the lower sash rail of the upper sash and the upper sash rail of the lower sash interlock to secure the panes in the closed position relative to one another within the window frame. The glazing is typically comprised of a glass or acrylic plastic sheet. Although, the glazing is preferably transparent, stained glass may work equally as well. A window with a single framed sheet of glazing is known as a pane.

The sashes of the window are held within the frame by stops. Stops are thin vertical strips placed on the inside, outside, and between the inner and outer sashes to maintain the two sashes in an upright position within the window frame. The innermost strip is the bead stop. The middle strip is the parting bead and the outermost strip is the blind stop. The bead stop, parting bead, and blind stop run up the side jambs and across the head.

Normally, the width of the upper sash is greater than the width of the lower sash wherein each sash width is equal to the width of the glazing plus the width of the sash stiles. The height of the sash opening is equal to the height of the glazing plus that of the top and bottom rails.

Older double-hung windows have the weight of each sash counterbalanced by sash weights. The sash weights are housed behind the side jambs and within the wall of the building and are connected to the sash by a sash cord. The sash cord extends over a pulley wheel set into the side jambs near the head. The use of sash weights simplifies the sliding motion of either sash of the double-hung window. It is known that modern manufacturing techniques have replaced the sash weight, sash cord, and pulley wheel with metal spring-loaded balances or friction mounted channels or various other assemblies to accomplish the same result.

The commonly used horizontal sliding window is generally similar to the double-hung window previously described except that the counterbalances of the double-hung window are not required. The counterbalances are not required because one sash merely slides horizontally behind the other sash so that neither sash must be raised above the other as in the vertical sliding sash window.

The picture windows are the simplest type of window. The well-known picture window includes a frame and a sash. The sash, having a glazing usually of one large sheet, is permanently and/or movably secured within the frame and is of a general construction that is similar to the double-hung window. The picture window constructed provides a wide viewing area.

Typical materials used to construct the different types of windows are premium grade lumber, vinyl coated lumber and various metals such as aluminum. However, the previously known windows as described are less than ideal because the windows are high profile and utilize unpreferred materials.

For example, various metal windows may include either a screwed or welded metal frame window. The screwed or welded metal frame window is unacceptable because metal is an excellent conductor of thermal energy and is susceptible to oxidation.

Although wood is a better insulator, a window made of wood requires a great deal more maintenance to preserve the overall appearance of the window. The additional expense and time required to repair and paint a weathered frame or sash offsets the advantages obtained from the increased insulation value of the wooden window.

Another type of window is constructed of all vinyl members. The vinyl window frame members are assembled with screws that secure the two side jambs, head, and sill and sill adapter to form the window frame. However, this type of construction suffers from the disadvantage of weak corner joints and increased air and water infiltration due to the difficulty of precisely matching the fit at the corners of the top, bottom and side members of the frame. Another disadvantage of the screw fastened vinyl frame window is that the window screen is retained in a separate track positioned on the top and bottom of the window. The screen track positioned on the top and bottom of the window frame requires a high profile sloped sill in order to drain moisture and the like away from the window pane. The high profile sloped sill results in a window with decreased visibility.

Another disadvantage of the previously known vinyl window is in the difficulty presented in the replacement of worn or broken parts of the window due to the manner in which all of the parts of the window frame are joined together. A further disadvantage of the vinyl frame window is that the components of the frame of the window have a tendency to change position as the sash of the window moves within the frame.

A fourth type of window utilizes wooden components coated with vinyl. The vinyl coating provides the low maintenance characteristics while the wooden core provides the increased insulation value to the window. However, vinyl coated wooden windows are expensive and are not easily maintained when a component of the sash or frame needs to be repaired or replaced.

Accordingly, to solve the problems presented by the previously known windows, the present invention comprises a welded window frame constructed of a rigid vinyl material or fiberglass reinforced vinyl material. The window includes various components that snap together to form the welded frame and the sash of the windows to provide a variety of different styles of windows.

The present invention incorporates the rigid vinyl material into the window frame to afford a lightweight, durable, low profile window for greater visibility and improved weatherability.

It is an object of the present invention to provide a window frame which has a welded master frame of improved insulation value and structural rigidity. It is a further object of the invention to provide a window frame and sash constructed of a material having a low thermal conductivity. It is a further object of the present invention to provide a screen track in cooperation with the welded window frame that holds a sill insert and a head insert tight against the frame. It is a further object of the invention to provide a sill insert that when inserted into the welded frame yields a low profile window. Yet another object of the present invention is to provide a double-hung window with equal glass widths for the top and bottom sashes. It is another object of the invention to provide a window that is aesthetically appealing, simple to construct and assemble and economical to manufacture. Another object of the present invention is to provide a welded vinyl master frame and inserts that cooperate with the master frame to create the type of low profile window desired. Yet another object of the present invention is to provide a window of inserts that can be easily replaced when broken or worn.

SUMMARY OF THE INVENTION

In accordance with the present invention, I have invented a low profile window having a window frame and at least one sash. The frame and sash are constructed from various inserts that are cooperatively combined with a master frame and a master sash. The frame and sash thereby formed are then combined to produce either a double-hung window, a single-hung window, a sliding window, or a picture window.

Preferably, a low profile window is formed having a welded window frame with welded miter joints and at least one sash having welded miter joints. The window frame includes at least two parallel side jambs, a head jamb extending perpendicular to and connecting the upper ends of the side jambs and a bottom sill extending perpendicular to and connecting the lower ends of the side jambs. The sash is comprised of a glazing, at least two parallel side stiles, a top rail extending perpendicular to and connecting the upper ends of the side stiles and a bottom rail extending perpendicular to and connecting the lower ends of the side stiles to completely enclose the outer peripheral edges of the glazing. The top rail, side stiles and bottom rail are constructed from a common master sash and at least one sash insert. The sash inserts in association with the master sash surround the outer peripheral edges of the glazing to form the sash. The sash is confined within the window frame to produce a variety of different low profile windows.

The double-hung window embodiment includes a first sash and a second sash. The first sash has a glazing, two parallel first side vertical sash stiles, a first top sash rail extending perpendicular to and connecting the upper ends of the first side stiles, and a first bottom sash rail extending perpendicular to and connecting the lower ends of the first side stiles to completely enclose the outer peripheral edges of the glazing. The first side vertical sash stiles each have a master sash of uniform cross section throughout the longitudinal extent and a glazing bead. The glazing bead is combined with the master sash to form each of the first side vertical sash stiles.

The first top sash rail includes the master sash of uniform cross section, a top rail cap, and the glazing bead. The glazing bead and the top rail cap are combined with the master sash to form the first top sash rail. The first bottom sash rail includes the master sash, a sash interlock, and the glazing bead, the sash interlock and the glazing bead are combined with the master sash to form the first bottom sash rail.

The lower sash includes a glazing, two parallel second side vertical sash stiles, a second top sash rail extending perpendicular to and connecting the upper ends of the second side stiles, and a second bottom sash rail extending perpendicular to and connecting the lower ends of the second side stiles to completely enclose the outer peripheral edges of the glazing. The second side vertical sash stiles each include the master sash of uniform cross section, the glazing bead, and a side rail extender. The glazing bead and the side rail extender are combined with the master sash to form each of the second side vertical sash stiles. The second top sash rail includes the master sash of uniform cross section, the sash interlock, and the glazing bead, the sash interlock and the glazing bead cooperate with the master sash to form the second top sash rail. The second bottom sash rail includes the master sash of uniform cross section, the glazing bead, and a bottom rail cap. The glazing bead and the bottom rail cap in cooperation with the master sash form the second bottom sash rail. The upper sash and the lower sash are operatively confined within the window frame to produce a sturdy low profile double-hung or single-hung window of field replaceable components.

The second embodiment of the present invention is the sliding window. The sliding window includes a window frame and at least two sashes. The window frame has two parallel side jambs, a head extending perpendicular to and connecting the upper ends of the side jambs and a bottom sill extending perpendicular to and connecting the lower ends of the side jambs. The parallel side jambs each comprise a welded master slider frame of uniform cross section throughout the longitudinal extent. The bottom sill comprises sill tracks and the welded master slider frame. The sill tracks are positioned within the welded master slider frame to form the slider bottom sill. The head also comprises the welded master slider frame. The abutting ends of the welded master slider frame of the head, side jambs and bottom sill are welded to form the window frame.

The first and second sash include a glazing, two parallel inner and outer slider sash stiles having upper and lower ends, a top slider sash rail extending perpendicular to and connecting the upper ends of the inner and outer slider sash stiles, and a bottom slider sash rail extending perpendicular to and connecting the lower ends of the inner and outer slider sash stiles to completely enclose the outer peripheral edges of the glazing of the first and second sash. The inner sash stiles include a master sash of uniform cross section throughout the longitudinal extent, a glazing bead, and a sash interlock, the glazing bead and the sash interlock in cooperation with the master sash form the inner sash stiles of the first and second sash. The outer sash stiles include the master sash, the glazing bead, and a slider rail cap. The glazing bead and the slider rail cap in cooperation with the master sash form the outer sash stiles. The top slider sash rail includes the master sash, the glazing bead and a slider rail cap. The glazing bead and the slider rail cap in cooperation with the master sash form the top slider sash rail. The bottom slider sash rail includes the master sash, the glazing bead, a slider rail cap and a roller housing and rollers. The glazing bead and slider rail cap in cooperation with the master sash form a chamber therebetween. The roller assemblies are secured within the chamber. The roller assemblies, the slider rail cap, the glazing bead and the master sash form the bottom slider sash rail. The first and second sash are operatively confined within the window frame to produce a sturdy low profile sliding window.

Another embodiment of the invention is the picture window. The picture window comprises a window frame and a sash. The window frame includes two parallel side jambs, a head extending perpendicular to and connecting the upper ends of the side jambs, and a bottom sill extending perpendicular to and connecting the lower ends of the side jambs. The parallel side jambs, head, and bottom sill each comprise a master frame of uniform cross section throughout the longitudinal extent, an exterior sash retainer, and interior sash retainers. The exterior sash retainer and the interior sash retainers in cooperation with the master frame form the side jambs, the head and the bottom sill of the window frame of the picture window.

The sash of the picture window includes a glazing, a top sash rail and a bottom sash rail that are horizontally spaced from one another and two vertical sash stiles extending between and perpendicular to the ends of the sash rails to form the sash and surround the peripheral edges of the glazing. The top sash rail, the bottom sash rail, and the vertical sash stiles include a master sash of uniform cross section throughout the longitudinal extent and a glazing bead. The glazing bead in cooperation with the master sash form the top sash rail, the bottom sash rail, and the vertical sash stiles. The sash may be permanently and/or movably secured within the window frame to produce the picture window.

DETAILED DESCRIPTION OF THE PREFERRED EMBODIMENTS

Figure 1:
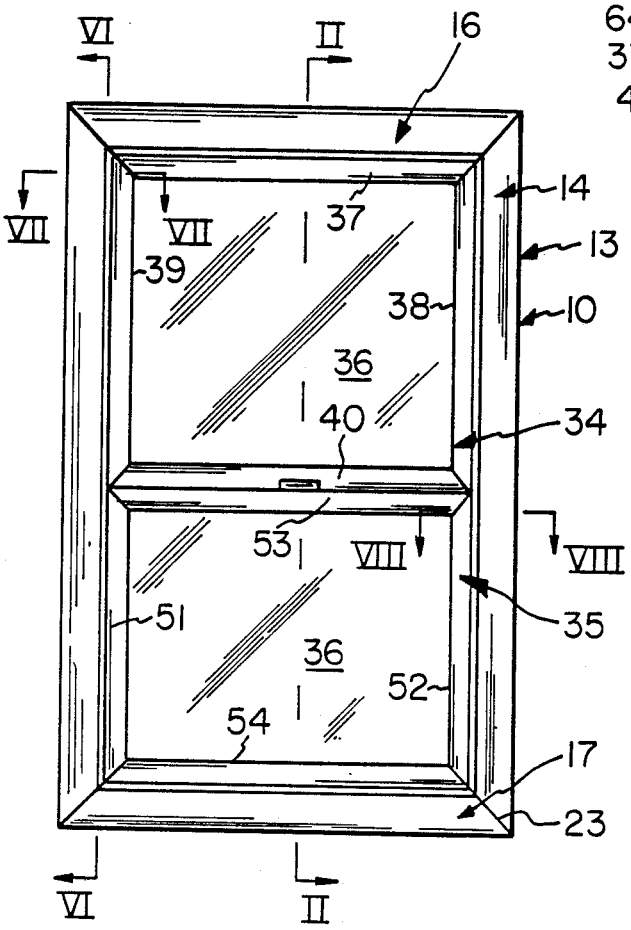
FIG. 1 is a front elevation view of a double-hung or a single-hung window of the present invention.

A window manufactured in accordance with the present invention includes a window frame and at least one sash constrained within the perimeter of the frame of the window. The window frame of each window includes two parallel side jambs, a head and a bottom sill. The head extends perpendicular to and connects the upper ends of the side jambs and the bottom sill extends perpendicular to and connects the lower ends of the side jambs. The sash of each window includes a glazing supported around the outer edges by a top rail, two side stiles, and a bottom rail. The top and bottom rails are spaced and parallel. The side stiles extend transversely between and connect the ends of the rails.

Referring now to the drawings, the drawings illustrate, as assembled, a double-hung or a single-hung window 10, a picture window 11 and a slider window 12.

As used herein, a direction moving from the frame to the center of the sash will be defined as "inward" and a direction moving from the center of the sash to the frame will be defined as "outward".

Although only a double-hung window embodiment is described herein in detail, it will be appreciated that a single-hung window may be formed in a manner similar to that of the double-hung window. The principle difference being that in the single-hung window embodiment of the present invention a first sash is secured in a fixed position such that only a lower second sash may move within the window frame.

Figure 2:
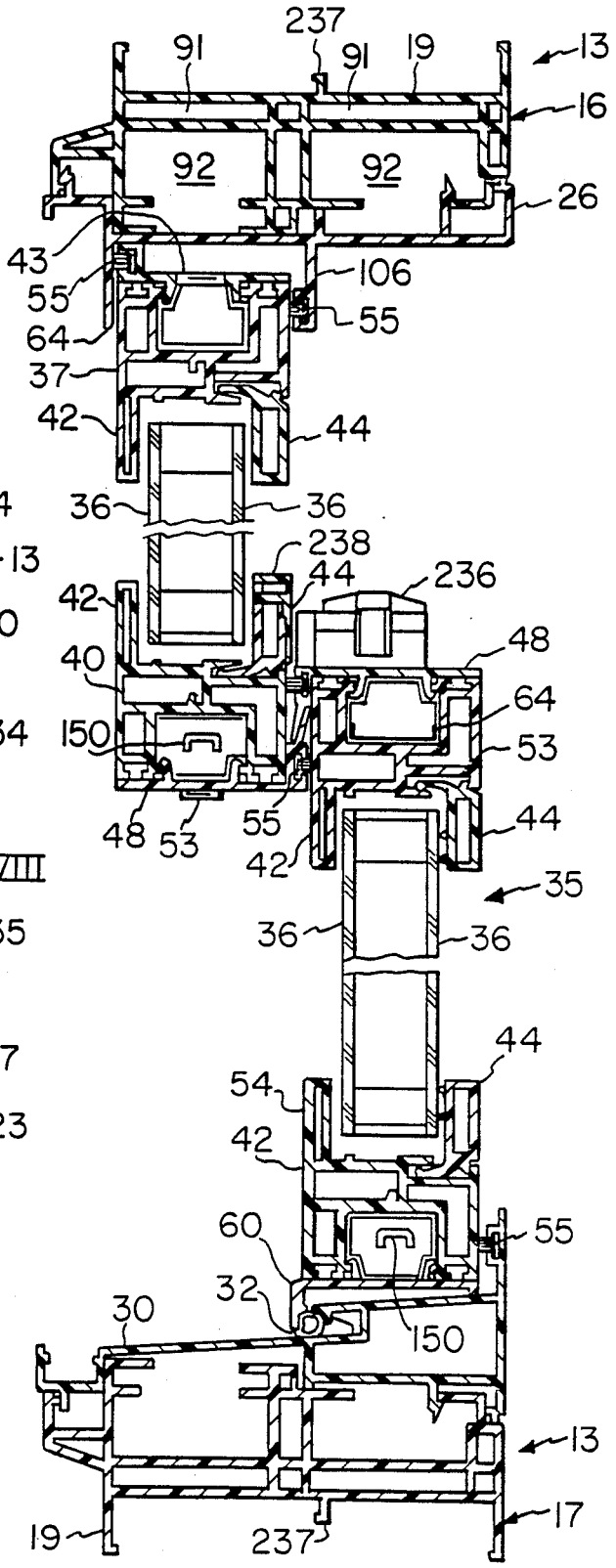
FIG. 2 is a cross-sectional view of the double-hung window of the present invention taken along line II—II of FIG. 1.
Figure 3:
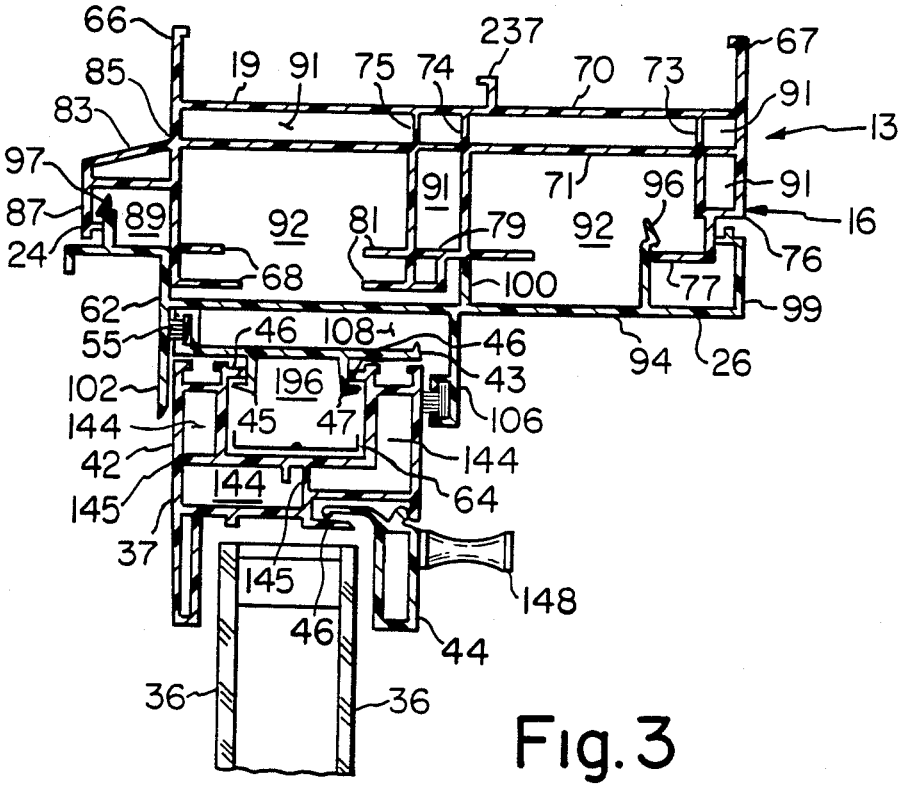
FIG. 3 is a partial cross-sectional view of the head and first top sash rail of the window of FIG. 2.
Figure 4:
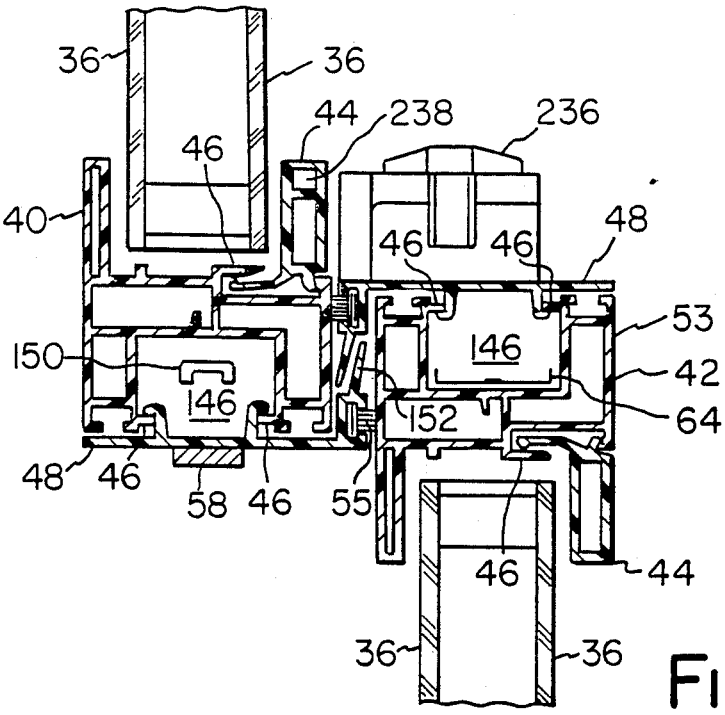
FIG. 4 is a partial cross-sectional view of the first bottom sash rail and second top sash rail of the window of FIG. 2.
Figure 5:
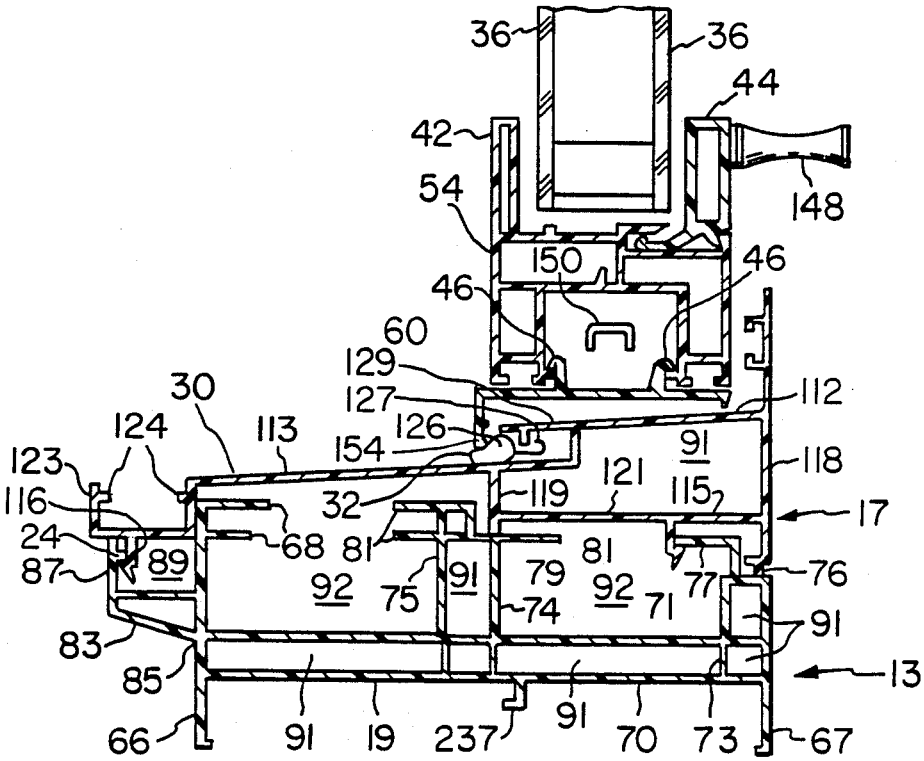
FIG. 5 is a partial cross-sectional view of the second bottom sash rail and bottom sill of the window of FIG. 2.
Figure 7:
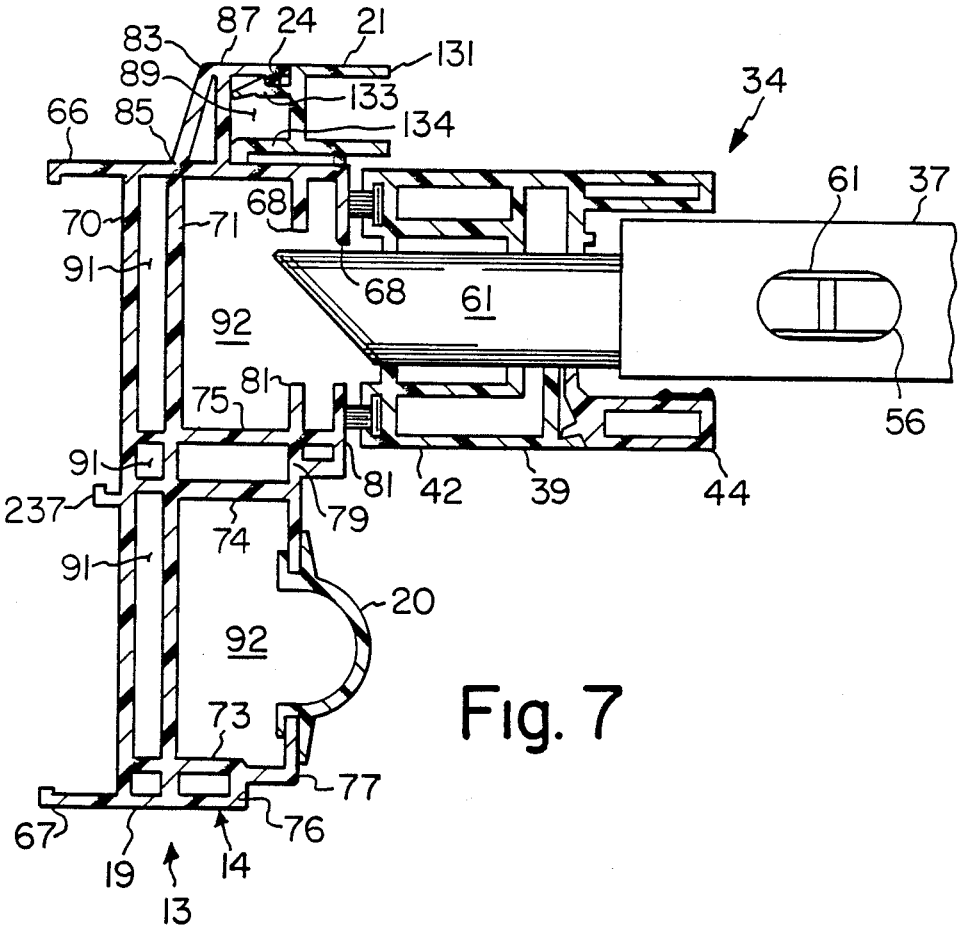
FIG. 7 is a cross-sectional view of the double-hung window of FIG. 1 taken along line VII—VII.
Figure 8:
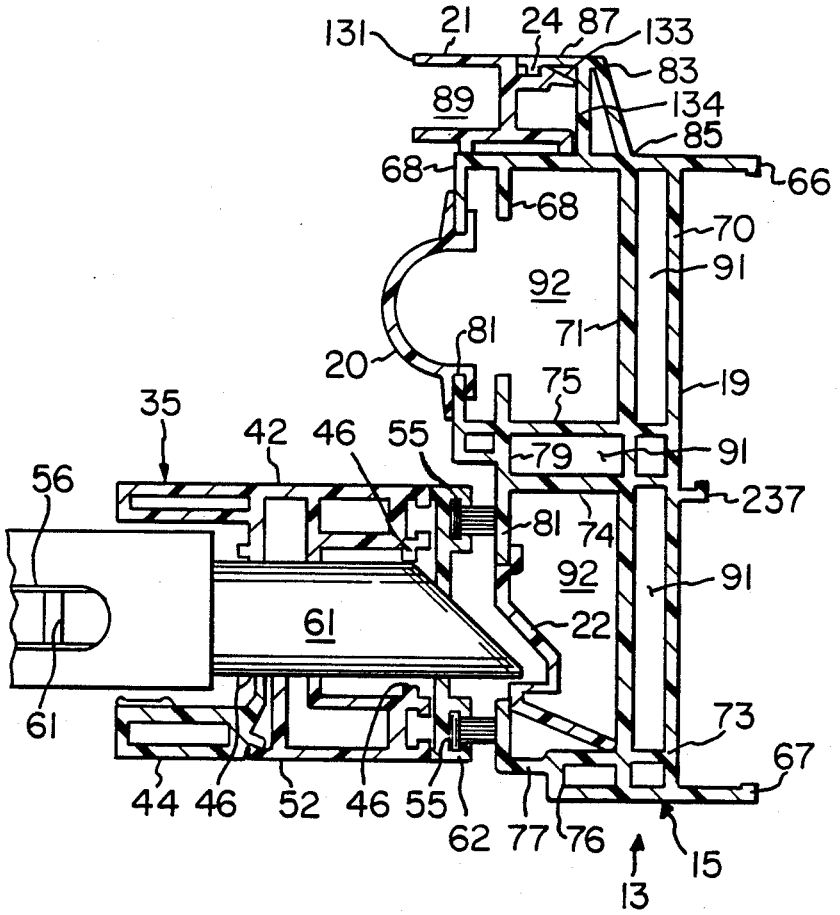
FIG. 8 is a cross-sectional view of the double-hung window of FIG. 1 taken along line VIII—VIII.

The double-hung window 10, shown in FIGS. 1–9 includes a window frame 13 having side jambs 14 and 15, a head 16 and a bottom sill 17. The side jambs 14 and 15 shown in FIGS. 7 and 8 are comprised of a common master frame 19, a sash stop 20, a screen track adapter 21 and a balance cover 22. The sash stop 20, screen track adapter 21 and balance cover 22 cooperate with and snap into flanges within the master frame 19 to form the side jambs 14 and 15. Similarly, the head 16 shown in FIGS. 2 and 3 is formed from a common master frame 19 and a head insert 26, and the bottom sill 17 shown in FIGS. 2 and 5 is formed from the common master frame 19 and a sill insert 30 and a bulb seal insert 32. The head insert 26 and the sill insert 30 and bulb seal insert 32 cooperate with and snap into flanges within the master frame 19.

The double-hung or the single-hung window of the present invention as shown in FIG. 1 includes a first sash 34 and a lower second sash 35. The first sash 34 has a glazing 36 supported around the outer edges thereof by a first top rail 37, two first side stiles 38 and 39, and a first bottom rail 40. The first top rail 37 and first bottom rail 40 are spaced and parallel. The first side stiles 38 and 39 extend transversely between and connect the ends of the first top and bottom rails.

As shown in FIGS. 2 and 3, the first top rail 37 of the first sash 34 is assembled from a common master sash 42, a top rail cap 43, and a glazing bead 44. The glazing bead 44 and top rail cap 43 cooperate with and snap into flanges in the master sash 42 to form the first top rail 37. The first bottom rail 40, shown in FIG. 4 is assembled from a sash interlock 48, glazing bead 44, keeper 238 and T-bar 58. The sash interlock and glazing bead cooperate with and snap into flanges 46 in the master sash 42. The keeper 238, of a conventional design, is formed integral with the glazing bead 44. Each first side stile 38 and 39, FIGS. 1 and 7 is also assembled from a glazing bead 44 and master sash 42. The glazing bead 44 cooperates with and snaps into flanges 46 within the master sash 42 to form first side stile 39.

The lower second sash 35 of the double-hung window as shown in FIG. 1, comprises a glazing 36 supported around the outer edges thereof by two parallel second stiles 51 and 52, a second top rail, and a second bottom rail 54. The top rail 53 and bottom rail 54 are spaced from one another with the side stiles 51 and 52 connected to the ends of the sash rails 53 and 54 such that the side stiles are perpendicular to the top and bottom sash rails. The second stiles 51 and 52, second top rail 53, and second bottom rail 54 are assembled from a master sash 42 identical to the master sash of the first sash 34.

The second top rail 53, shown in FIG. 4, comprises the master sash 42, a tilt latch housing 56, a sash interlock 48, and glazing bead 44 that are identical to, and are assembled in a manner similar to the master sash 42, sash interlock 48, and glazing bead 44 of the first bottom rail 40. The second bottom rail 54, shown in FIG. 5, includes a glazing bead 44, a bottom rail cap 60, and master sash 42. The glazing bead 44 and bottom rail cap 60 cooperate with and snap into flanges 46 formed within the master sash 42. The second side stiles 51 and 52 as shown in FIGS. 1 and 8 include the master sash 42, glazing bead 44, and side rail extender 62. The glazing bead 44 and side rail extender 62 cooperate with and snap into flanges 46 formed within the master sash 42 to produce the second side stiles 51 and 52 of the second sash 35.

The master frame 19 of FIGS. 2–8 is of uniform cross-sectional configuration throughout the length of the frame of the double-hung window 10. In particular, referring to FIGS. 3 and 5, the cross section of the master frame 19 has a first sidewall 66 and a second sidewall 67. The second sidewall 67 is spaced from and generally parallel to the first sidewall 66. The length of the second sidewall 67 is shorter than the length of the first sidewall 66. First sidewall 66 has braces 68 extending perpendicularly from an end extending beyond second sidewall 67. First sidewall 66 and second sidewall 67 are connected by first and second connecting walls 70 and 71. First and second connecting walls, parallel and spaced from one another, are transverse to first and second sidewalls 66 and 67. Extending transversely from the first connecting wall 70 and parallel to the first and second sidewalls 66 and 67 are three parallel spaced support walls 73, 74 and 75. The first support wall 73 is adjacent the second sidewall 67, projects from the first connecting wall 70, intersects the second connecting wall 71, and terminates at a distance equivalent to the terminal end of the second sidewall 67. An end section 76 extends between and connects ends of the first support wall 73 and second sidewall 67 to form a shelf therebetween. The end section 76 has an inwardly directed L-shaped flange 77 of the master frame 19 protruding from the end section 76. The second support wall 74 and third support wall 75 are adjacent one another and extend transversely from approximately the middle of the first connecting wall 70, intersect the second connecting wall 71, and extend beyond the second connecting wall. The second support wall 74 terminates short of the third support wall 75 and is connected to the third support wall at the terminal ends thereof by crosspiece 79. The crosspiece 79 is perpendicular to the second support wall 74 and third support wall 75 and projects outwardly beyond the sides of the second and third support walls to provide braces 81.

Extending outward from the point of intersection of the second connecting wall 71 and first sidewall 66 is a triangular extension 83 that is sloped downward and away from the first sidewall 66. At the intersection of triangular extension 83 and first sidewall 66 are conventional weep holes 85 to allow drainage of moisture and the like from the master frame 19. Connected to the tip of the triangular extension is a downwardly protruding channel sidewall 87 that is parallel to the first sidewall 66 and terminates at a distance equivalent to the uppermost brace 68 of the first sidewall 66. Channel sidewall 87, triangular extension 83, and first sidewall 66 form channel 89.

As illustrated in FIGS. 2, 3 and 5, the first and second connecting walls 70 and 71, first and second sidewalls 66 and 67, first, second and third support walls 73, 74 and 75, end section 76, crosspiece 79 and triangular extension 83 combine to define air chambers 91 and hollows 92 in master frame 19. It will be appreciated that the air chambers 91 provide increased rigidity and improved insulation value to the master frame 19 and assembled window.

Although the master frame 19 as described forms part of the head 16 of the double-hung window 10, an identical master frame is employed and is specifically designed to form a part of the side jambs 14 and 15 and bottom sill 17. The master frame sections utilized in the head 16, side jambs 14 and 15, and bottom sill 17 are each positioned with hollows 92 directed toward the center of the window of FIG. 1 with channel 89 positioned toward the exterior of the building in which the window is used.

The master frame component of the head 16, side jambs 14 and 15, bottom sill 17 are each positioned such that the ends of each master frame abut one another to form miter joints 23. The miter joints 23 are closed by a welding action in which the joints are subjected to an elevated temperature and pressure. The elevated temperature and pressure cause the joints to self-bond and create a gap-free joint therebetween. As illustrated in FIG. 1, all four joints of the master frame are closed through the weld method as described.

The head 16 of the window frame 13 of the present invention is assembled from the master frame 19 and head insert 26. Referring to FIG. 3, the cross section of the head insert 26 consists generally of a horizontal planar base member 94 extending from the second sidewall 67 to a point just beyond the first sidewall 66 of the master frame 19. Two head fingers 96 and 97 and two braces 99 and 100 extend upwardly from the planar base member 94 and secure the head insert 26 to flanges 24 and 77 of the master frame 19. The first brace 99 of the head insert 26 extends upwardly and contacts against the end section 76 extending between the second sidewall 67 and the first support wall 73. The first finger 96 of the head insert 26 extends upwardly from the base member 94 and snaps into the end of the inwardly directed L-shaped flange 77 of the master frame 19. The second upwardly extending brace 100 projects against the brace 81 extending from the terminal end of the second support wall 74. Connected to the end of the planar base member that extends beyond the first sidewall 66 is an inverted L-shaped track guide 102. The planar base member 94 is connected to approximately the middle of the vertical member of the inverted L-shaped track guide 102 such that the vertical member is positioned against the first sidewall 66, and forms a right angle with the planar base member. Extending upwardly from the base of the inverted L-shaped track guide 102 is a second finger 97 which cooperates with and snaps into flange 24 formed within the inwardly facing side of the channel sidewall 87 of the master frame 19.

Extending perpendicularly downward from the planar base member is a head sidewall 106. The head sidewall extends downward a distance equivalent to the downward projection of the track guide 102. It will be appreciated that track guide 102 and head sidewall 106 are spaced apart and parallel with respect to one another to form a sash channel 108 to receive and allow the first top rail 37 to slide therebetween. The distance between track guide 102 and head sidewall 106 is approximately one-half the width of the planar base member 94 of the head insert 26.

As shown in FIGS. 2 and 5, the bottom sill 17 of the window 10 comprises master frame 19, sill insert 30, and bulb seal insert 32. The master frame 19 of the bottom sill 17 is positioned with channel 89 positioned inward and with hollows 92 directed upward toward the center of the window such that the bottom sill master frame 19 is a mirror image of the master frame utilized in the head 16. The sill insert 30 and bulb seal insert 32, of uniform cross section, are of a length to extend between the sections of the master frame 19 forming the side jambs 14 and 15 of the window frame 13.

The cross-sectional configuration of the sill insert 30 generally consists of two uneven inclined planes 112 and 113. The planes 112 and 113 are inclined to allow drainage of moisture and the like away from the interior of the building in which the window is used. The second plane 113 of the sill insert 30 is positioned below and connected to the first plane 112 of the sill insert such that the first plane overhangs the second plane to form a step.

The sill insert 30 is securely fastened to the master frame 19 by two downwardly protruding sill fingers 115 and 116 and two braces 118 and 119. The first brace 118 is connected to the end of the first plane 112 which is closest to the interior of the building. The first brace 118 extends upwardly from end section 76, connects to plane 112, and projects past the plane. It will be appreciated that first brace 118 projects past plane 112, to provide a rim to ensure moisture and the like flows away from the interior of the building and to provide a weathertight seal when second bottom sash rail 54 of the second sash 35 is sealed against the first plane 112. The second brace 119 is connected to the underside of the second plane 113 and extends downward to the second support wall 74 of the master frame 19. A crosspiece 121 extends between and connects the first brace 118 and the second brace 119 to form air chamber 91 in the sill insert 30. The first finger 115 extends downward from the crosspiece 121 and cooperates with and snaps into L-shaped flange 77 of the master frame 19. Connected to the end of the second plane 113 that is positioned furthest from the interior of the building is screen track 123. The screen track 123 is formed as an integral part of the sill insert 30. The screen track 123 is generally U-shaped and has on the inside of each upwardly extending arm of the U-shaped screen track flanges 124. The flanges of the screen track secure a screen (not shown) between the upwardly extending arms of the track when the screen is seated within the track. The second downwardly extending finger 116 is connected to the underside of the U-shaped screen track 123 and cooperates with and snaps into flange 24 formed on channel sidewall 87 of the master frame 19.

The bulb seal insert 32 of the bottom sill 17 comprises a bulb 126 connected to an extension 127. Typically the bulb 126 is made of a synthetic elastomer. The extension 127 snaps into a flange 129 in the overhang formed by plane 112 overlapping plane 113. It will be appreciated that when the bulb seal insert is in place only the bulb of the bulb seal insert is revealed. Moreover, the bulb seal insert 32 may be easily removed and replaced as desired. When the second sash 35 is closed against the bottom sill 17, the second bottom rail 54 seals against the bulb seal insert 32 and forms a weathertight seal.

The side jambs 14 and 15 of the window frame 13 are shown in FIGS. 7 and 8 and include the master frame 19, a screen track adapter 21, a sash stop 20 and a balance cover 22. The master frame 19, identical to the master frame previously described for the head 16 and bottom sill 17, is vertically positioned such that one master frame is on each side of the ends of the head and bottom sill. The hollows 92 of the master frame 19 are directed inward toward the center of the window. The cross-sectional configuration of the screen track adapter 21 of the side jambs 14 and 15 consists of a U-shaped track guide 131 and two track fingers 133 and 134. The track fingers extend from the underside of the track guide 131 and cooperate with and snap into the flange 24 formed in the channel sidewall 87 and snap against the first sidewall 66, respectively.

It will be appreciated that the screen track adapter 21 when snapped within the master frame 19 prevents the sashes 34 and 35 from laterally moving within the window frame 13 and forms a unitary window screen track with sill insert screen track 123. Furthermore, the screen track adapter 21 when snapped within the master frame 19 snuggly retains the snap-in sill insert 30 and snap-in head insert 26 against the master frame.

The sash stops 20, arcuate in cross section, extend a portion of the length of the side stiles 51 and 52 of the first sash 34 equivalent to the distance between the inward side of the head 16 to the balance cover 22 and are positioned directly above the lower sash 35 on the inward side of side jambs 14 and 15. The sash stops 20 positioned directly above the second sash 35 are secured between the brace 68 of the first sidewall 66 and brace 81 of the third support wall 75 such that the sash stops arc inward toward the center of the window. The sash stops 20 also extend a portion of the length of the vertical stiles 38 and 39 of the second sash 35 from the sill insert 30 to the balance cover 22 and are located directly below the first sash 34 on the outward side of side jambs 14 and 15. The sash stops 20 positioned directly below the first sash 34 are secured to the master frame 19 between the L-shaped flange 77 and brace 81 of the second support wall 74 such that the sash stops arc inward toward the center of the window. It will be appreciated that sash stops 20 act as a stop for the movement of the first sash and second sash as the sashes move vertically within the window frame.

Figure 6:
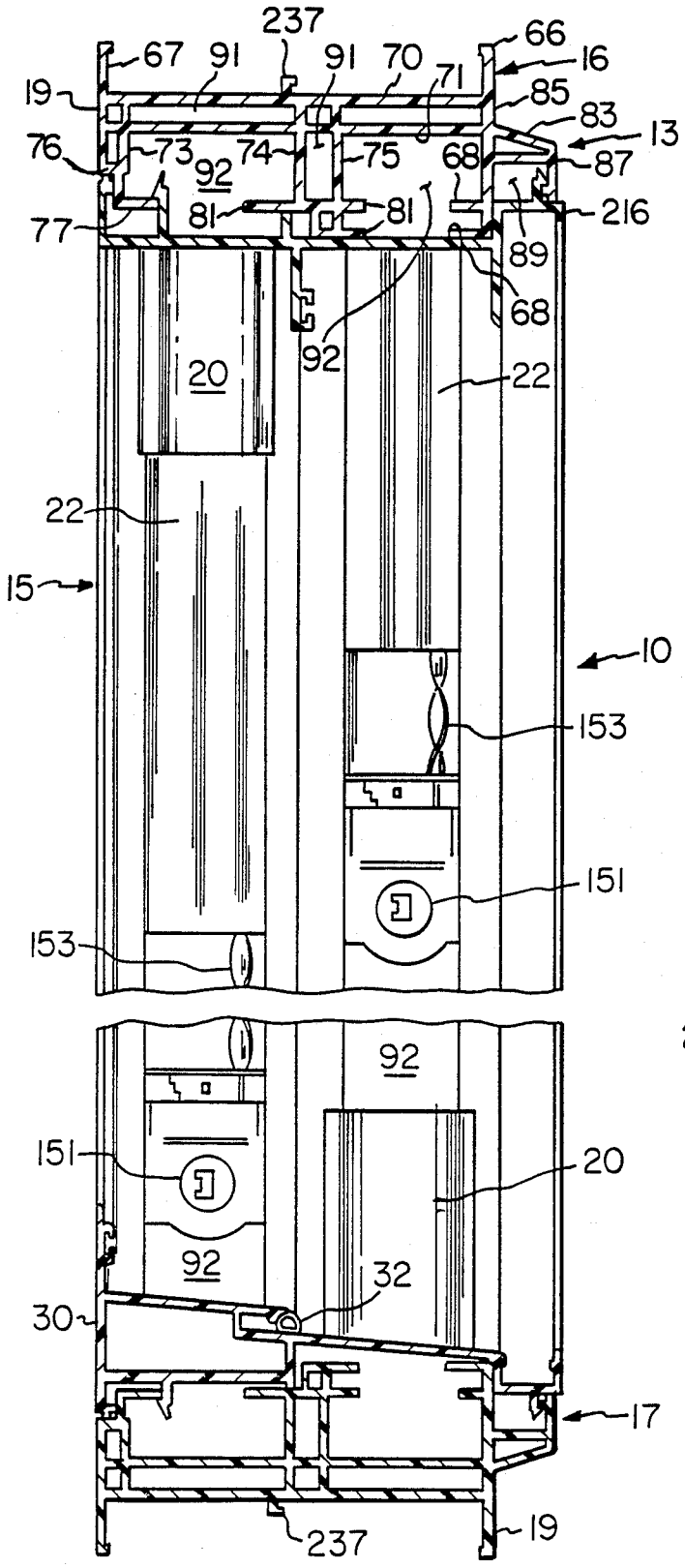
FIG. 6 is a partially fragmented cross-sectional view of the double-hung window of the present invention taken along line VI—VI of FIG. 1.

The balance cover 22 shown in FIGS. 6 and 8 is of a conventional design and extends between brace 81 and L-shaped flange 77 approximately the length of a sash stile to protect the balance associated with the sash.

The first and second sashes 34 and 35 of the double-hung window embodiment of the present invention generally comprise at least one sheet of glazing 36, parallel, horizontally spaced apart top and bottom rails, and two sash stiles extending between the ends of the rails such that the sash stiles are perpendicular to the sash rails. The sheet of glazing is supported adjacent its outer periphery and secured within the sash.

Figure 10:
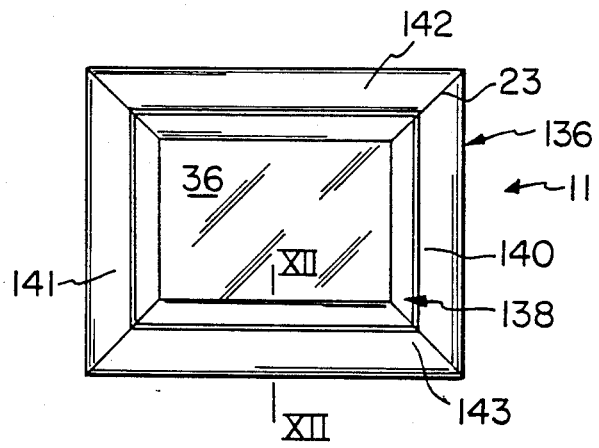
FIG. 10 is a front elevation perspective view of a picture window of the present invention.
Figure 13:
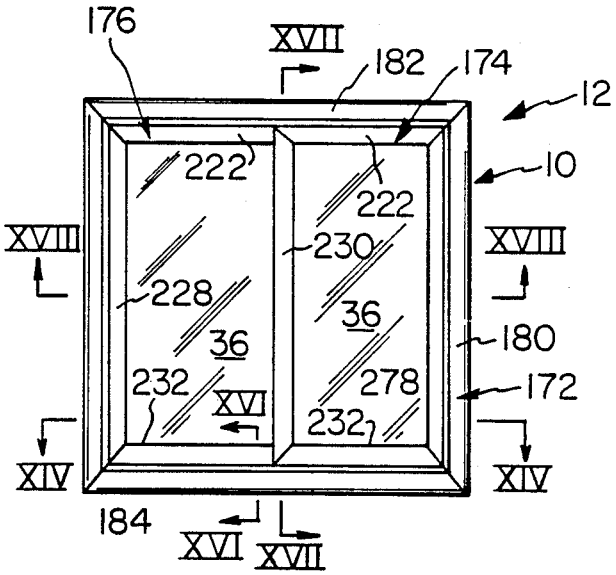
FIG. 13 is a front elevation view of a slider window of the present invention.

For purposes of illustration, FIGS. 1, 10 and 13 show a variety of window styles employing two sheets of glazing. However, it will be appreciated that any number of sheets of glass may be employed in the window of the present invention. For example, additional sheets of glazing may be added to the existing double-pane window by a gasket bridging the gap between the additional third pane and the double-pane window. Each pane is supported adjacent the outer periphery of the glass sheets by a gasket which is secured in recesses formed in the sash stiles, top sash rails, and bottom sash rails. In general, it is preferred that the panes of glass are preassembled with the edges sealed to create a single assembly for ease of installation within a recess as defined herein.

The first top rail 37 of the double-hung window as shown in FIG. 3 comprises a master sash 42, glazing bead 44, and top rail cap 43. The master sash 42 is of a uniform cross-sectional configuration throughout the length of the sash rail. In particular, the master sash 42 is of an inverted h shape, cross-sectional configuration having a double-wall thickness for increased rigidity and strength. Extending between the double-wall thick master sash are sash crosspieces 145. The sash crosspieces 145 also provide increased structural rigidity to the sash and define sash air chambers 144 to provide increased insulation value to the window. The two upwardly projecting members of the inverted h-shaped master sash each has directly opposing inner sash flanges 46 at the ends thereof. A sash stiffener 64 to be more fully described herein, is placed between the two upwardly projecting members and flush against the horizontal base of the h-shaped master sash 42.

The top rail cap 43 extends the longitudinal length of the master sash 42 and is generally of a planar body of a width to fit between the track guide 102 and head sidewall 106. Two rail cap fingers 45 and 47 protrude downward from the planar body and cooperate with and snap into sash flanges 46, and thereby define chamber 146. An upward extension 63 offset from the outwardly facing end of and perpendicular to the planar body of the top rail cap 43 defines a weather strip pocket 55. The weather strip pocket 55 is a T-shaped groove as shown and accommodates a weather strip of preferably a woven pile construction.

The glazing bead 44 may be a snap-in type or may be secured by screws and is of a general boot shape construction that is inserted into flange 46 in the corner directly across from and on the same end as the single downwardly projecting member of the inverted h-shaped master sash 42. The glazing bead 44 extends downwardly parallel to and spaced from the single downwardly projecting member of the inverted h-shaped master sash to form a recess to receive the glazing. It will be appreciated that the distance between the glazing bead 44 and the single downward member is such that the glazing fits securely therebetween. A lift handle 148 of a conventional design may be secured to the first top rail 37 to facilitate in the vertical movement of the first sash 34 within the window frame 13. In a preferred embodiment, the lift handle 148 is extruded as part of the snap-in glazing bead 44.

As shown in FIG. 7, first top rail 37 also includes a tilt latch housing 56 which includes a retractable latch 61 secured within each end of chamber 146 of first top rail 37. By sliding latch 61 of each tilt latch housing toward one another, the upper portion of first sash 34 may be tilted toward the interior of the room away from window frame 13. Referring to FIG. 2, the first sash must first be lowered slightly to avoid interference with head sidewall 106.

The first bottom rail 40, shown in FIG. 4, is an identical mirror image of the first top rail 37 except that top rail cap 43 is replaced by a sash interlock 48; and a T-bar 58, a sash chamber 146 containing a pivot pin 150 are added. It will be appreciated that the sash interlock 48 is identical to the top rail cap 43 except that an interlock means 152 extends from the end of the weather strip pocket 55 of the top rail cap 43.

The interlock means 152 consists of a diagonally protruding arm attached to the weather strip pocket 55. The diagonally protruding arm extends diagonally upward and away from the center of the planar body of the top rail cap 43.

Figure 9:
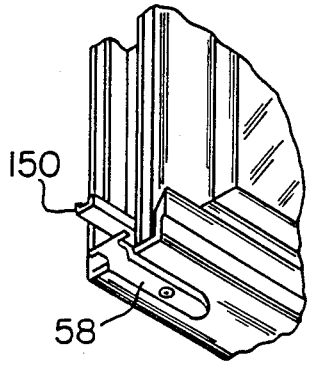
FIG. 9 is a partially fragmented perspective view of a bottom portion of a sash.

The T-bar 58, more fully shown in FIG. 9, is fastened to the underside of each end of the bottom rail 40 of the first sash 34. The T-bar 58 of a T-shape rides in the hollows 92 of the side jambs 14 and 15 against braces 68 and 81 and flange 77 to provide stability and maintain the sash flush against the side jambs 14 and 15.

Pivot pin 150, as shown in FIGS. 2, 5 and 9, is essentially rectangular in cross section. The pivot pin 150 extends outward from the longitudinal ends of the sash chamber 146 of the first bottom sash rail 40 and into a shoe 151 (FIG. 6) positioned within the hollows 92 of the side jambs 14 and 15 of the window frame 13 to allow for pivotal movement of the bottom rail of the first sash 34. The shoe 151 may be of any conventional type used in double-hung tilt windows. The shoe 151 is attached to a helical rod portion 153 of a conventional balance. Accordingly, when the first sash 34 is tilted, the pivot pin 150 and T-bar 58 pivot along with it.

The second top rail 53 of the second sash 35, as shown in FIG. 4, is identical to the first bottom rail 40 of the first sash 34 except that sash rail 53 is inverted with respect to sash rail 40. Therefore, as illustrated by FIGS. 2 and 4, the interlock means 152 of each sash interlock 48 overlap to form a weathertight seal between the first and second sashes 34 and 35 when the sashes are in the closed position, as shown in FIG. 1. As shown in FIG. 8, second top rail 53 also includes a tilt latch housing 56 which includes a retractable latch 61 secured within each end of chamber 146 of second top rail 53. By sliding latch 61 of each tilt latch housing toward one another the upper portion of second sash 35 may be tilted toward the inside of the room away from window frame 13.

The second bottom rail 54, shown in FIG. 5, consists of the master sash 42, glazing bead 44, and bottom rail cap 60. The master sash 42 and glazing bead 44 are identical to that previously described. The bottom rail cap 60 is identical to the top rail cap 43 as previously described except that a sealing member 154 extends perpendicularly downward from the outward edge of the top rail cap 43. The sealing member 154 forms a weather tight seal with the bottom sill when the sash is in the closed position. A lift handle 148 is also secured to or preferably extruded as part of the glazing bead 44 on the inwardly facing side of the second bottom rail 54 to facilitate in the vertical movement of the second sash 35 within the window frame 13.

The sash stiles 38 and 39, FIGS. 1 and 7, of the first sash 34 are identical to the first top rail 37 except the top rail cap 43 is omitted. Similarly, sash stiles 51 and 52, FIGS. 1 and 8, of the second sash are identical to the first top rail 37 except that the top rail cap 43 is replaced by side rail extenders 62 which are similar in shape to the rail cap. The side rail extenders 62 each include a weather strip pocket 55 on each end of the planar body which extends outward from the rail cap in a direction opposite to the downwardly protruding flanges 46 as previously described and shown in FIG. 2. The weather strip pockets 55 are formed integral with the top rail cap 43 to form the side rail extenders 62 which compensate for the setback created by the shorter first support wall 73, second sidewall 67, L-shaped flange 77 and brace 81 extending from the support wall 74. It will be appreciated that because side rail extenders 62 compensate for the setback in the side jambs 14 and 15, the window produced in accordance with this invention has equal glass widths for the first and second sashes 34 and 35.

In FIGS. 2 and 4, there is shown a rotatable latch member 236 secured to the sash interlock 48 of the second top rail 53. The rotatable latch member is rotated into a die cast latch keeper 238 which is secured within a prefabricated slot within the glazing bead 44 of the first bottom rail 40. It will be appreciated that the latch keeper 238 and latch member 236 are of a conventional design and are positioned to give a low profile appearance to the window and cooperatively prevent the relative movement of each sash within the window frame 13.

The bottom rail 54 of the second sash 35 is provided on each end thereof with a shoe 151. Each shoe 151 is positioned in an associated hollow 92, and can slide up and down within the side jambs 14 and 15. The shoe 151 may be of any conventional type used in double-hung tilt windows. The balance shoe 151 is attached to a helical rod portion 153 of a conventional balance and assists in the movement of the second sash 35. A pivot pin 150 which is essentially rectangular in cross section projects from each shoe and is secured within sash chamber 146 of the bottom sash rail 40 and 54 of each sash. Accordingly, when the first and second sashes 34 and 35 are tilted, the pivot pin 150 and T-bar 58 pivot along with it.

As shown in FIGS. 2–8, the window produced in accordance with present invention is provided with weather stripping such as a wool pile at various points of contact between the first and second sash and the window frame. The weather stripping is mounted in elongated weather strip pockets 55 formed in the extruded top rail cap 43, head insert 26, first and second sash interlocks 48 and sill insert 30.

FIG. 10 illustrates a picture window 11 made in accordance with the present invention. Generally, the picture window comprises a frame 136 and a sash 138.

The frame 136 consists of two parallel side jambs 140 and 141, a head 142 extending perpendicular to and connecting the upper ends of the side jambs and a bottom sill 143 extending perpendicular to and connecting the lower ends of the side jambs.

The side jambs 140 and 141, head 142 and bottom sill 143 each consist of a master frame 19, an exterior sash retainer 164, and interior sash retainer 162 or 163. The exterior and interior sash retainers 162, 163 and 164 snap into the previously described flange 24 and braces 81 of the master frame 19 to form the frame 136. The master frame 19 is identical to that previously described for the double-hung and single-hung window embodiments of the invention.

The master frames of the sides of the frame of the picture window are each positioned such that the ends of each master frame abut to form miter joints 23. The miter joints 23 are closed as previously described for the double-hung window embodiment to create gap-free joints therebetween and thereby form a rigid picture window frame.

Figure 11:
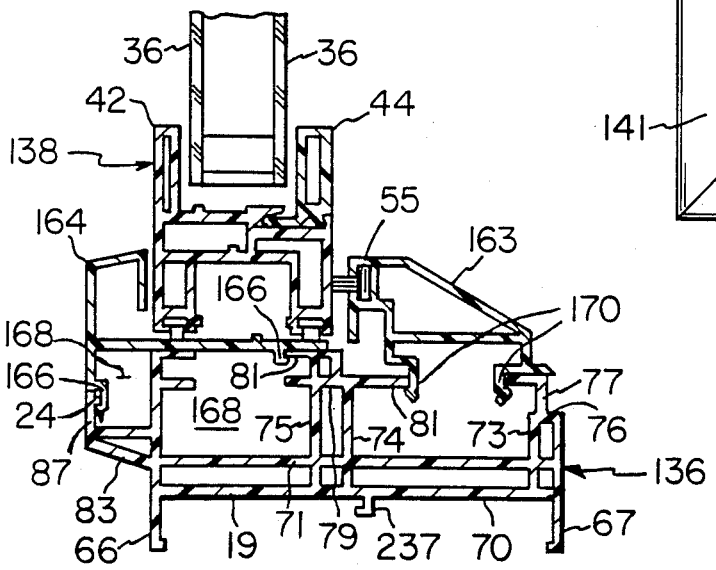
FIG. 11 is a cross-sectional view of the picture window of FIG. 10 taken along line XI—XI.
Figure 12:
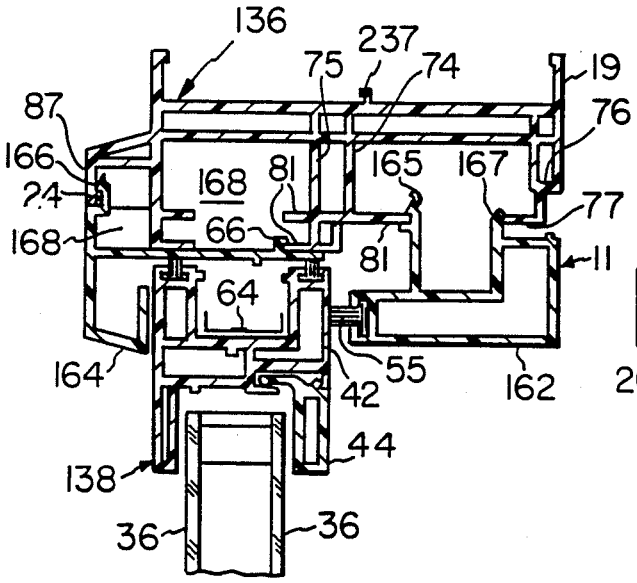
FIG. 12 is a cross-sectional view of the picture window of FIG. 8 taken along line XII—XII.

The exterior sash retainer 164 is fitted completely around the exterior of the window frame 136. The exterior sash retainer, as shown in FIGS. 11 and 12 has a horizontal T-shaped uniform cross-section. The T-shaped exterior sash retainer extends from the third support wall 75 to the channel sidewall 87. Sash retainer fingers 166 extend transversely from the T-shaped retainer 162 and snap into the most distant brace 81 extending from the third support wall 75 and into the flange 24 of channel sidewall 87 such that two air chambers 168 are formed. One end of the downwardly extending vertical portion of the horizontal T-shaped retainer is formed as an inwardly directed hook which is aligned with the first sidewall 66 of the master frame 19. The inwardly directed hook forms a weather protective and decorative strip to protect the joint created at the connection of the sash 138 and master frame 19 of the picture window. As shown in FIGS. 10–12, the exterior sash retainer 164 is snapped into the master frame and then the joints formed by the abutting horizontal and vertical exterior sash retainers 164 are welded to the master frame to form a unitary frame structure.

Interior sash retainer 162 and interior sash retainer 163 are installed in the vertical and horizontal positions, respectively, with respect to the window frame. Interior sash retainers 162 and 163 are fitted completely around the interior of the window frame.

Vertical interior sash retainer 163 is generally of a right triangle cross-sectional shape. The right angle of the triangularly shaped sash retainer is positioned adjacent the corner formed by the inward side of the sash 138 and inward side of master frame 19. Extending from the base of the triangularly-shaped sash retainer 163 positioned adjacent the master frame are two finger extensions 170. The finger extensions 170 snap into the L-shaped flange 77 of the master frame 19 and brace 81 of the second support wall 74, respectively. A weather strip pocket 55 is extruded as part of the inward side of sash retainer 163.

The horizontal interior sash retainer 162 is of a generally double wall thick L-shape cross-section. One leg of the "L" butts against flange 77 extending from end section 76 of the master frame 19, and the remaining leg butts against the inward side of the master sash 42. A weather strip pocket 55 is extruded as part of the interior sash retainer 162 and projects from the leg of the "L" adjacent the inward side of the master sash against the sash to provide a weathertight seal. Two fingers 165 and 167 extend transversely outward from the leg of the "L" adjacent the inward side of the master frame. The fingers cooperate with and snap over brace 81 and flange 77, respectively to retain sash retainer tight against master sash 42 and master frame 19.

The sash 138 of the picture window embodiment of the present invention generally comprises at least one sheet of glazing 36, a parallel, horizontally spaced top and bottom rail, and two side stiles extending between the ends of the rails such that the sash stiles are perpendicular to the sash rails. The top and bottom rail and side stiles include a master sash 42 and a glazing bead 44. The master sash and glazing bead, and glazing are identical to and are formed in an identical fashion as the master sash, glazing bead, and glazing of the double-hung window. The sash 138 is permanently retained between the exterior sash retainer 164 and interior sash retainers 162 and 163 of the window frame as illustrated by FIGS. 10–11.

FIG. 13 illustrates a slider window manufactured in accordance with the present invention. The slider window generally comprises a slider frame 172 and a plurality of sashes. At least one of the sashes being movable. As shown in FIG. 13–19, the slider window is constructed of a first sash 174 and a second sash 176. The first sash 174 and second sash 176 operatively slide horizontally within the slider frame 172.

Figure 14:
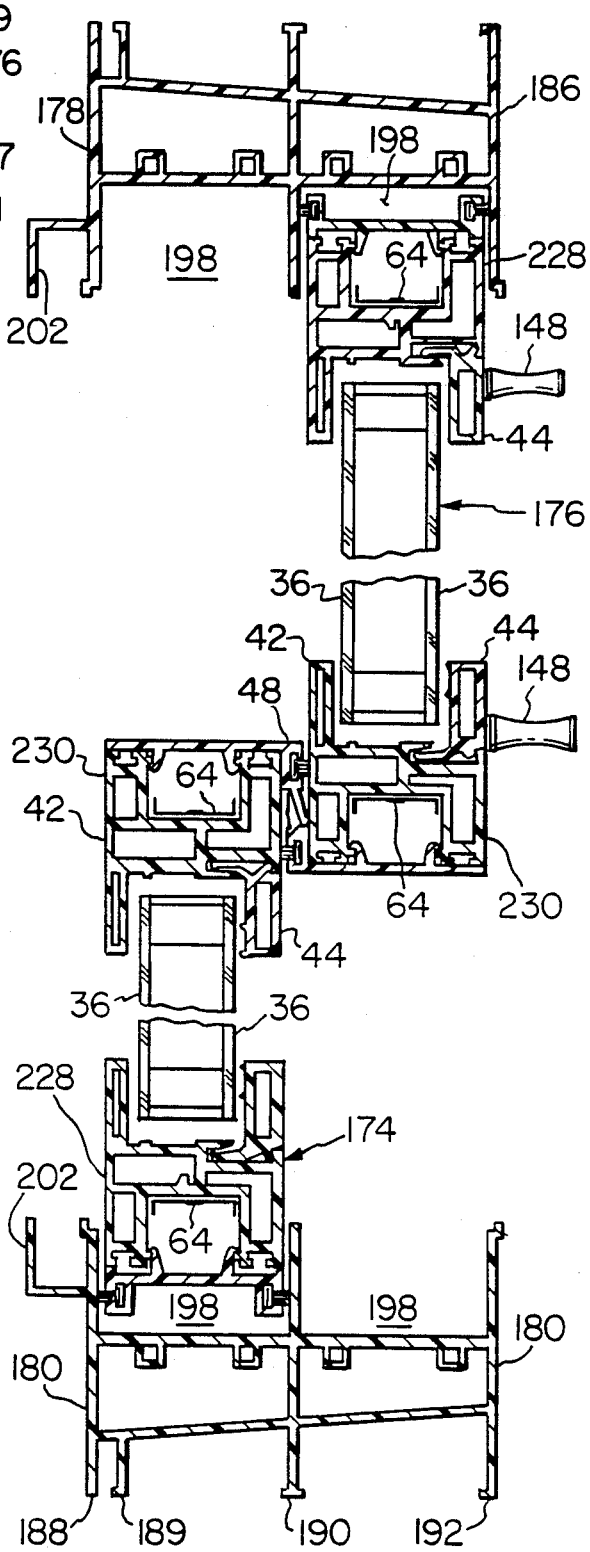
FIG. 14 is a partial cross-sectional view of FIG. 13 taken along line XIV—XIV.
Figure 15:
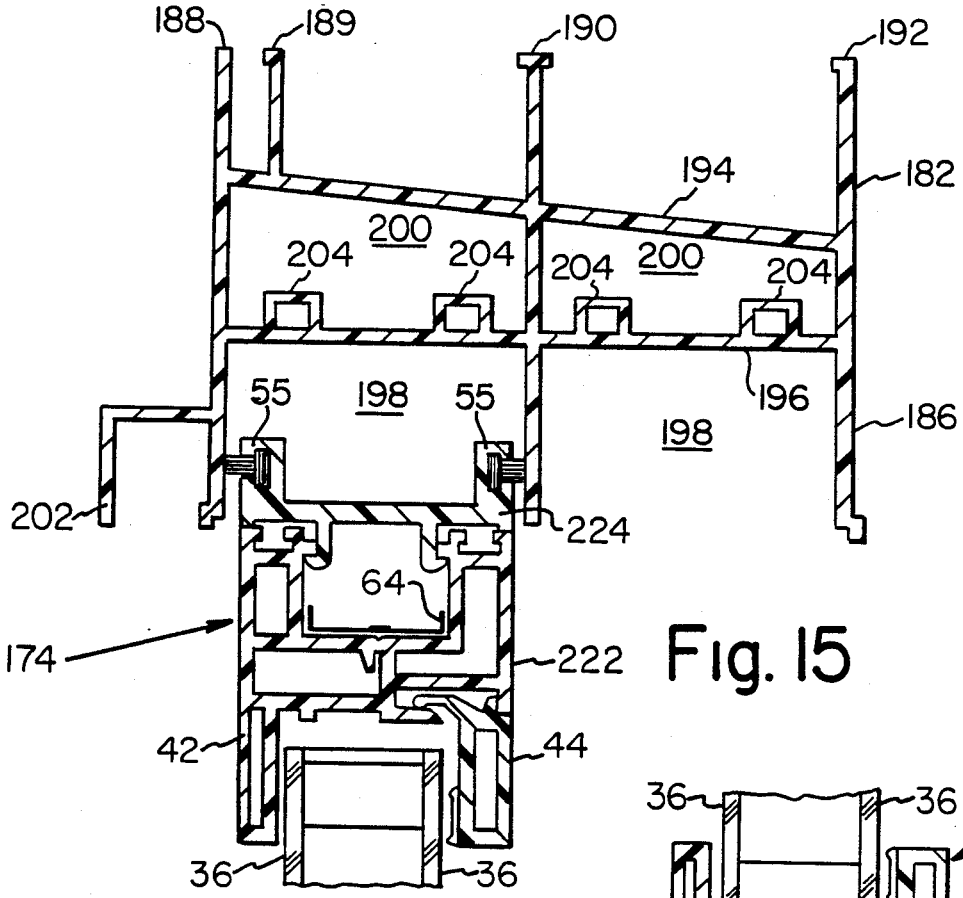
FIG. 15 is a cross-sectional view of FIG. 13 taken along line XV—XV.
Figure 16:
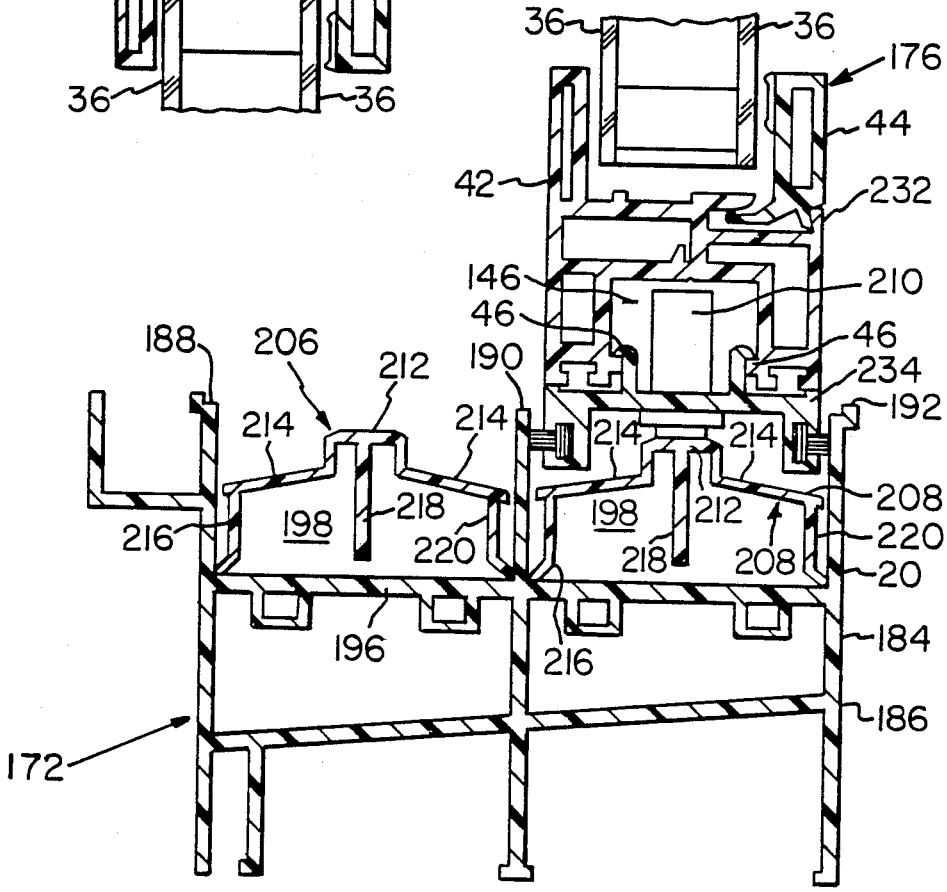
FIG. 16 is a cross-sectional view of FIG. 13 taken along line XVI—XVI.

In one embodiment, the slider frame 172 is comprised of two parallel slider side jambs 178 and 180, shown in FIG. 14, a slider head 182, shown in FIG. 15, extending perpendicular to and connecting the upper ends of the slider side jambs, and a slider bottom sill 184, shown in FIG. 16, extending perpendicular to and connecting the lower ends of the slider side jambs.

The slider head 182 is comprised of a slider master frame 186. The cross-sectional configuration of the slider master frame 186 comprises three parallel vertical slider walls of equal length 188, 190 and 192. The three slider walls 188, 190 and 192 are equally spaced and interconnected by two spaced crosspieces 194 and 196. Crosspiece 196 extends perpendicularly from slider wall 192 through slider wall 190 and to slider wall 188 such that the crosspiece is connected to each of the slider walls intermediate the ends thereof. Crosspiece 196 and slider walls 188, 190 and 192 form slider channels 198 therebetween. Crosspiece 1 = is also connected to slider walls 192, 190 and 188. The crosspiece 194 is downwardly inclined or angled from outer slider wall 188 to inner slider wall 192 to form air chambers 200 in the slider master frame 186. Projecting from the downward end of slider wall 188 is a downwardly directed L-shaped extension. The L-shaped extension and slider wall 188 form a screen track 202 on the exterior side of the slider wall of the slider master frame 186.

It will be appreciated that, if necessary, additional crosspieces may be utilized to connect the slider walls 188, 190 and 192 to further strengthen the slider master frame. As illustrated in FIG. 15, c-shaped members 204 are attached to the upwardly facing side of the connecting crosspiece 196 to further strengthen the slider master frame.

The parallel slider side jambs 178 and 180, shown in FIG. 14, are each comprised of the master slider frame 186. The master slider frames are each positioned such that the screen track 202 is facing away from the interior of the building and the slider channels 198 are directed inward toward the center of the sliding window.

The slider bottom sill 184, FIG. 16, is comprised of a slider master frame 186 and sill tracks 206 and 208. The slider master frame 186 is identical to the slider master frame previously described. Positioned between slider walls 188, 190 and 192, and within slider channels 198 are sill tracks 206 and 208. The sill tracks 206 and 208 provide a smooth surface for a roller 210 of each sash 174 and 176 to travel along when the sash slides horizontally within the window frame. The cross-section of the sill tracks 206 and 208 are each generally shaped as a mound 212 connected on each side thereof to two downwardly diverging frame members 214. Mound 212 is designed to provide a smooth surface for rollers 210 of the slider window to ride upon yet provide improved drainage capabilities for moisture and the like away from the rollers. The frame members 214 extend between the slider walls 188, 190 and 192 of the slider master frame 186 and are supported by sill track support walls 216, 218 and 220. Intermediate sill support wall 218 and end support walls 216 and 220 extend from the mound and frame members, respectively. Intermediate sill support wall 218 terminates just short of crosspiece 196, thereby allowing mound 212 to flex and cushion the impact of the rollers as the first and second sashes slide within the slider frame. Sill support walls 216 and 220 extend to crosspiece 196 of the slider master frame 186.

Figure 17:
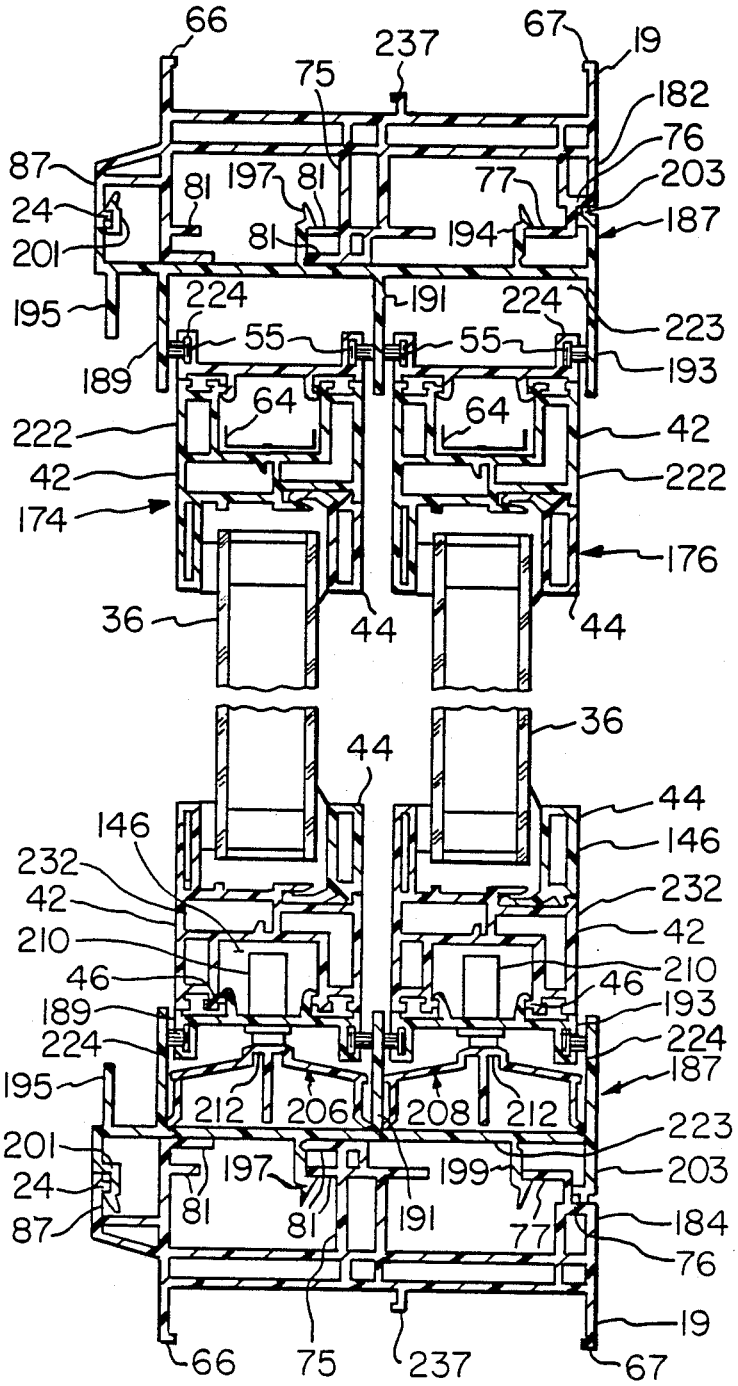
FIG. 17 is a cross-sectional view of an alternative embodiment of the slider window of FIG. 13 taken along line XVII—XVII.
Figure 18:
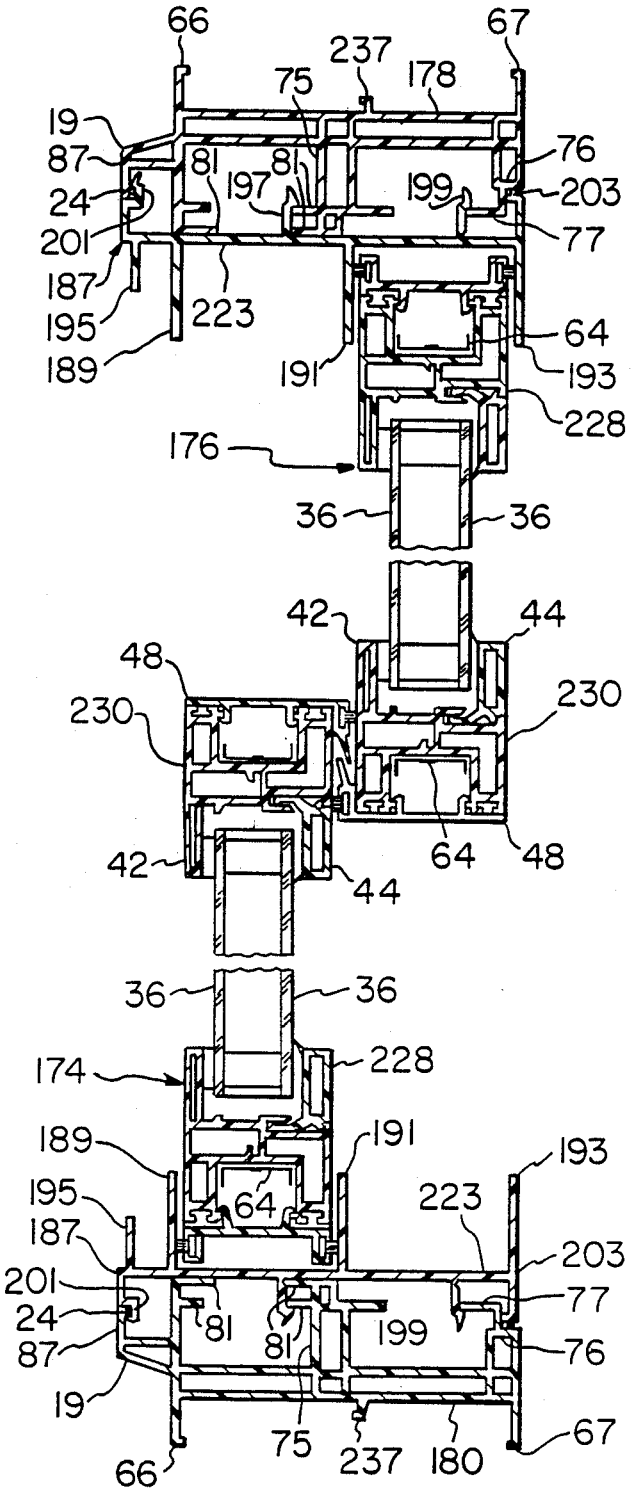
FIG. 18 is a cross-sectional view of an alternative embodiment of the slider window of FIG. 13 taken along line XVIII—XVIII.
Figure 19:
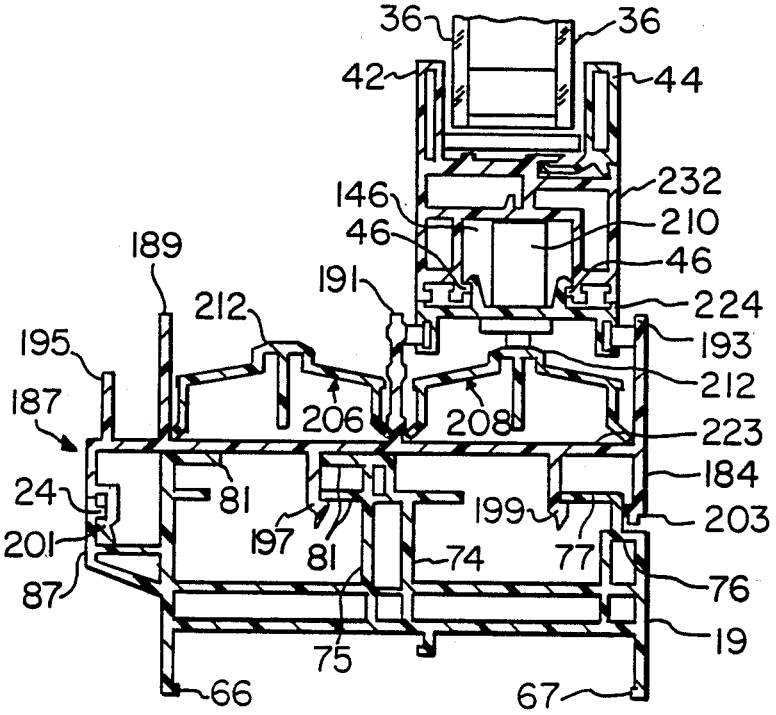
FIG. 19 is a cross-sectional view of a bottom sill of the slider window of FIG. 17.

FIGS. 17–19 show an alternative embodiment of a slider window, including a slider bottom sill 184, slider side jambs 178 and 180 and slider head 182 including the master frame 19. The master frame 19 is identical to the master frame of the double-hung, single-hung and picture windows and is used in place of the slider master frame 186 previously described. A slider frame adapter 187 snaps into master frame 19 to form the slider master frame. The slider frame adapter 187 includes a generally planar base 223 parallel to the master frame 19. Three retaining members 189, 191 and 193 and a screen track member 195 extend transversely from the planar base. The retaining members are equally spaced a distance equivalent to the span between first sidewall 66 and second sidewall 67 and are positioned adjacent L-shaped flange 77 and end section 76, and braces 81 of third support wall 75 and first sidewall 66 to receive sill track between said retaining members. The screen track member 195 extends transversely from the base opposite channel sidewall 87 and retaining member 189 to form a screen track. Three fingers 201, 197, and 199 extend transversely from planar base 223 and retain slider frame adapter 187 against master frame 19. First finger 201 cooperates with and snaps into flange 24 formed on channel sidewall 87 of master frame 19. Similarly, second and third finger 197 and 199 cooperate with and snap over brace 81 and flange 77, respectively. A brace 203 extends transversely from slider frame adapter and contacts against end section 76 thereby securely retaining the slider frame adaptor relative to master frame 19.

The master slider frames of the slider side jambs, slider head, and slider bottom sill are each positioned such that the ends of each master frame abut to form miter joints 23. The miter joints 23 are closed by the previously described welding action to create gap-free joints therebetween, and thereby form a rigid window frame.

As shown in FIGS. 15 and 17 the top slider rail 222 is of an identical uniform cross-sectional configuration for both the first and second sashes 174 and 176. The top slider rail 222 comprises the master sash 42, glazing bead 44 and slider rail cap 224. The master sash 42 and glazing bead 44 are identical to that previously described in the single-hung and double-hung window embodiments and in the picture window embodiment. The slider rail cap 224 is similar in shape and placement as the top rail cap 43 of the double-hung window. Slider rail cap 224 is designed to conform to the shape of the sill tracks 206 and 208 and present a low profile with minimal clearance between the sill track 208 and rail cap 224. As shown in FIGS. 15 and 17, rail cap 224 is welded to master frame 42 to securely seal rail cap and master sash and thereby prevent air and moisture infiltration. Slider rail cap 224 is formed by modifying top rail cap 43 by adding one matching weather strip pocket 55 offset from weather strip pocket 55 of top rail cap 43. The weather strip pockets 55 may contain an insulating material such as a fibrous insulating material. The weather strip pockets 55 are positioned between and against the interior of the vertical slider walls 188, 190, and 192 of FIG. 15 and retaining members 191, 193 and 189 of FIG. 17 to provide a weathertight seal.

The outer side stiles 2g FIGS. 13, 14 and 18 of the first and second sashes 174 and 176 are identical to the top slider rail 222 previously described in FIGS. 15 and 17. The outer side stiles 228 slide between the slider walls 180, 190 and 192 of FIGS. 15 and 16, and retaining members 191, 193 and 189 of FIGS. 17 and 19, respectively.

The inner slider stiles 230 shown in FIGS. 14 and 18 are comprised of the master sash 42, glazing bead 44, and sash interlock 48. The master sash, glazing bead and sash interlock are of identical shape and are asembled in a similar fashion as the master sash, glazing bead and sash interlock of the double-hung window as shown in FIGS. 1, 2 and 4.

The bottom slider rail 232, shown in FIGS. 16, 17 and 19, comprises master sash 42, glazing bead 44, slider rail cap 224 and roller 210. The master sash, glazing bead and slider rail cap are identical to that previously described. The roller 210 is of a conventional design and is secured within chamber 146 that is formed by snapping slider rail cap 224 into the flanges 46 of the master sash 42. The roller 210 travels on mound 212 of the sill tracks 206 and 208 and facilitates in the smooth sliding action of the first and second sashes 174 and 176 within the master slider frame 172.

The top and bottom slider rails 222 and 232 are spaced apart and parallel with respect to one another such that the inner and outer slider stiles 230 and 228 extend perpendicular to and join the respective ends of the sash rails to form the first and second sashes 174 and 176.

A handle 148 may be applied to the inwardly facing side of the glazing bead 44 of the slider stiles 228 and 230 to facilitate in the movement of each of the sashes 174 and 176 within the slider frame. The handle 148 is of a conventional design and may either be fastened to the glazing bead or preferably extruded as a part of the glazing bead in a single process. Encased within the first and second sashes 174 and 176 is glazing 36. Glazing 36 is of a type identical to that previously described herein.

Figure 20:
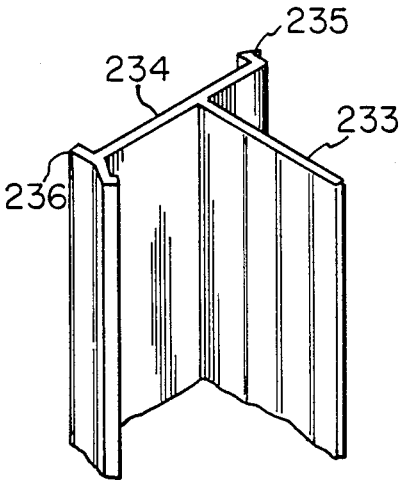
FIG. 20 is a partial perspective view of a nail fin.

The window manufactured in accordance with the present invention may be installed as either a replacement window or a prime window. As shown in FIG. 20, a nailing fin may be added to the master frame of FIGS. 1–19 to make possible installation as a prime window in a structure as the structure is built. The nailing fin includes two intersecting planer members 233 and 234 formed in the shape of a "T". Member 234 terminates in securing flanges 235 and 236 at each respective end thereof to secure the nailing fin to the master frame 19 of FIGS. 1–13 and 17–19 and master frame 186 of FIGS. 14–16. In particular, securing flange 235 is connected to first sidewall 66 and securing flange 236 is connected to a knob 237 extending transversely outward from first connecting wall 70 of master frame 19 as shown in FIGS. 1–13 and 17–19. Similarly, securing flange 235 is connected to retaining member 189 and securing flange 236 is connected to wall 190 of master frame 186 as shown in FIGS. 14–16.

Typically, the assembled window, when used as a prime window, is placed within a framed opening within the structure. Conventional fasteners are then driven through member 233 into the framing thereby securing the window within the opening.

Preferably, the window frame components and the sash components of the various varieties of windows described herein may be made of polymeric materials such as polyvinyl chloride and the like and may be produced using conventional extrusion or injection molding methods. The window frame and sashes manufactured in accordance with the present invention are of a sufficient wall thickness to produce a window that is structurally sound and therefore does not require additional reinforcing members. However, if necessary, the master sash 42 is designed to accept a sash stiffener 64 as shown in FIGS. 2–4 and FIGS. 14, 15, 17 and 18. The sash stiffener typically is made of aluminum or any suitable material and extends the length of the master sash.

It will be appreciated that because each section of the double-hung window, picture window and slider window is constructed of interchangeable components that may be easily snapped together by the use of fingers and flanges, durable and simple windows that are easy to repair and maintain may be assembled.

Having described presently preferred embodiments of the invention, it is to be understood that it may be otherwise embodied within the scope of the appended claims.

I claim:

1. A low profile window comprising:

(a) a window frame of a polymeric material including at least two parallel side jambs, a head jamb extending perpendicular to and connecting at welded miter joints the upper ends of the side jambs and a bottom sill extending perpendicular to and connecting at welded miter joints the lower ends of the side jambs; said side jambs, said head and said bottom sill are formed of a common master frame and window frame inserts that snap into said common master frame, said master frame in cross-section having a first sidewall and a shorter second sidewall spaced parallel thereto; first and second spaced parallel connecting walls transverse to and joining said first sidewall and said second sidewall; first, second and third spaced parallel support walls extending perpendicularly from said first connecting wall and parallel to said first and second sidewalls, said first support wall adjacent said second sidewall and projecting from said first connecting wall through said second connecting wall to said second sidewall, said second support wall and said third support wall positioned parallel and adjacent one another and extending from a middle portion of said first connecting wall through said second connecting wall and terminating beyond said second connecting wall and said second support wall terminating short of said third support wall; an end section extending between and connecting said terminal ends of said first support wall and said second sidewall to form a shelf therebetween; an L-shaped flange protruding from said end section and directed toward said second support wall; a crosspiece connecting said third support wall and said second support wall at the terminal end thereof and projecting beyond sides of said second and third support walls; a traingular shaped extension extending from a point of intersection of said second connecting wall and said first sidewall, said triangular extension having a protruding channel sidewall connected thereto and parallel to said first sidewall and terminating at a distance approximately equivalent to the projection of said first sidewall; said first and second connecting walls, said first and second sidewalls and said first, second and third support walls, end section, crosspiece and triangular shaped extension cooperatively forming said master frame cross section; and (b) at least one sash of a polymeric material and including a glazing having outer peripheral edges, at least two parallel side stiles, a top rail extending perpendicular to and connecting at welded miter joints the upper ends of the side stiles and a bottom rail extending perpendicular to and connecting at welding miter joints the lower ends of the side stiles to completely enclose the outer peripheral edges of said glazing, said top rail, said side stiles and said bottom rail constructed from a common master sash and at least one sash insert, said common master sash generally having a double wall h-shape cross-section and a plurality of sash crosspieces extending between said double walls of said master sash to reinforce said master sash such that said at least one sash insert in cooperation with said master sash surrounds the outer peripheral edges of said glazing to form said sash, said sash confined within said window frame to produce said low profile window.

2. The low profile window as set forth in claim 1 further comprising braces and sash flanges, said braces extending perpendicularly from said terminal end of said first sidewall and said sash flanges extending perpendicularly from inward surfaces of said double wall thick parallel leg members of said h-shaped master sash, said braces and said sash flanges in cooperation with said window frame inserts and said sash inserts, respectively, forming said low profile window.

3. The low profile window as set forth in claim 2, including a first sash and a second sash, said first sash and said second sash confined within said window frame to produce said low profile window.

4. The low profile window as set forth in claim 3, wherein said window frame inserts of the bottom sill include a sill insert and a bulb seal insert, said sill insert having a first and a second inclined plane, at least one finger and at least one brace, said second plane positioned below and connected to said first plane such that said first plane overhangs said second plane forming a step, said finger and said brace connecting said first and second plane to said master frame, said bulb seal insert having a bulb connected to an extension, said extension fastened to said sill insert between said first and said second plane, such that said second sash in a closed position seals against said bulb seal insert and said first plane of said bottom sill to form a weathertight seal.

5. The low profile window as set forth in claim 4, wherein said window frame inserts of said side jambs include a screen track adapter and a plurality of sash stops, said screen track adapter having a track guide of a U-shaped cross-section and a plurality of track fingers, said track fingers connecting said U-shaped track guide with said channel sidewall of said master frame, said screen track adapter retaining said sill insert and said head insert against said master frame, said sash stop having an arcuate cross-section and connected to said master frame of said side jambs and positioned directly above said second sash and directly below said first sash thereby limiting the vertical movement of said first and second sash.

6. The low profile window as recited in claim 5 wherein, said head includes said master frame and a head insert, said head insert having a horizontal base member connected at one end thereof to an L-shaped track guide and at an intermediate portion thereof to a head sidewall, said base member including a plurality of head fingers and braces extending from said base member to secure said head insert to said master frame to form said head such that said top rail slides between said track guide and said head sidewall.

7. The low profile window as set forth in claim 6, wherein said sash inserts forming said side stiles, said top rail and said bottom rail of said first and second sash include a glazing bead, said glazing bead having a general boot shape body and an integral handle, said glazing bead positioned parallel to and spaced from the single projecting member of said h-shaped master sash such that said glazing is securely positioned between said glazing bead and said master sash.

8. The low profile window as set forth in claim 7, wherein said sash inserts forming said top rail include a top rail cap, said top rail cap having a generally planar body of a width to fit between said track guide and said head sidewall, said planar body having a plurality of fingers depending therefrom and a weather strip pocket extending transversely from one end of said planar body, said fingers of said top rail cap securing said top rail cap to said master sash.

9. The low profile window as recited in claim 8 wherein, said bottom rail includes a sash interlock, a T-bar and a pivot pin;

said sash interlock having a generally planar body including a plurality of protruding fingers and an interlock means extending from a weather strip pocket formed integrally with an end of said body, said fingers cooperatively secure, said sash interlock to said master sash to form a chamber therebetween, said T-bar of a T-shaped cross section fastened to each end of said bottom rail such that said T-bar maintains said sash flush against said side jambs.

10. The low profile window as recited in claim 9, further comprising a tilt latch housing including a retractable latch secured within said chamber of said top rail such that as said latch is retracted said sash may be titled from said window frame.

11. The low profile window as recited in claim 10, further comprising a side rail extender of a generally planar body having a plurality of fingers depending therefrom and a weather strip pocket extending transversely outward from each end of said planar body, said fingers of said top rail securing said side rail extender to said master sash.

12. The low profile window as recited in claim 10, wherein said window frame inserts include exterior sash retainers and an interior sash retainer; said exterior sash retainer and said interior sash retainer in cooperation with said master frame form said side jambs, said head jamb and said bottom sill of said low profile window.

13. The low profile window as recited in claim 1 wherein one sash is confined within said window frame;

said single sash comprising a glazing having peripheral edges, a top sash rail and a bottom sash rail horizontally spaced apart, and two vertical sash stiles extending between and perpendicular to said sash rails to form said sash and surround the edges of said glazing.

14. The low profile window as recited in claim 13 wherein said sash inserts include a glazing bead of a general boot shape body cross-section having an integral handle, said glazing bead positioned parallel to and spaced from the single projecting member of said h-shaped master sash such that said glazing is securely positioned between said glazing bead and said master sash.

15. The low profile window as recited in claim 14 wherein, said window frame inserts include exterior sash retainers and interior sash retainers, said exterior sash retainer of a generally T-shape cross-section having a hoot like end aligned with said first side wall extending from said third support wall to said channel sidewall and secured to said master frame around the peripheral exterior of said window frame by a plurality of sash retainer fingers.

16. The low profile window as recited in claim 15 wherein the sash inserts include a glazing bead and a sash interlock; said glazing bead and said sash interlock in cooperation with said master sash form said inner sash stiles of said first and second sash of said sliding window.

17. The low profile window as recited in claim 15, wherein said interior sash retainer is of a type having a general right triangle cross-section positioned adjacent a corner formed by the inward vertical side of said sash and the inward vertical side of said master frame and secured to said master frame by a plurality of finger extensions.

18. The low profile window as recited in claim 17, wherein said interior sash retainer is of a type having two leg members forming a general double wall thick L-shape cross-section, one leg of said L-shape interior sash retainer positioned adjacent said L-shaped flange of said horizontal master frame and the remaining leg positioned adjacent the inward horizontal surface of said master sash and secured to said master frame by a plurality of finger extensions.

19. The low profile window as recited in claim 18 wherein, said window frame inserts include a slider frame adapter having a generally planar base, at least three equally spaced retaining members extending transversely from one planar surface of said planar base and a plurality of fingers extending from the remaining planar surface of said planar base and a screen track member extending transversely from said planar base, said slider frame adapter secured to said master frame by said plurality of fingers such that said screen track is positioned opposite of channel sidewall.

20. The low profile windows as recited in claim 1 wherein said window frame is a slider window frame, including two parallel slider side jambs having an upper end and a lower end, a slider head jamb extending perpendicular to and connecting the upper ends of said slider side jambs, and a slider bottom sill extending perpendicular to and connecting the lower ends of said slider side jambs to form said slider window frame.

21. The low profile window as recited in claim 20 wherein, said window frame inserts include a slider frame adapter having a generally planar base, a plurality of equally spaced retaining members extending transversely from said planar base and a screen track member extending transversely from said planar base opposite of channel sidewall, said slider frame adapter secured to said master frame by a plurality of fingers.

22. The low profile window as recited in claim 21 wherein, said window frame inserts include a sill track positioned between each of said retaining members, said sill track cross-section generally of a mound shape connected at each side thereof by two downwardly diverging members which terminate in support walls and connected at a middle portion thereof by an intermediate support wall said sill track and said slider frame adapter cooperatively forming said slider bottom sill.

23. The low profile window as recited in claim 22 wherein said sash includes at least two sashes, each sash having a spaced and parallel top and a bottom slider sash rail and an inner and outer slider sash stile extending perpendicular to and joining the respective ends of said sash rails to form each sash.

24. The low profile window as recited in claim 23 wherein, said sash inserts include a glazing bead and a slider rail cap;

said glazing bead of a general boot shape body cross-section having an integral handle;

said glazing bead positioned parallel to and spaced from the single projecting member of said h-shaped master sash such that said glazing is securely positioned between said glazing bead and said master sash, said slider rail cap having a generally planar body, two protruding fingers to cooperatively secure said slider rail cap to said master sash and two weather strip pockets attached to each end of said planar body to form said top slider rail and outer sash stiles and provide a weather tight seal between said sash and said window frame.

25. The low profile window as recited in claim 24 wherein, said sash inserts include a glazing bead, a slider rail cap, and a roller;

said glazing bead and said slider rail cap cooperatively combine to form a chamber therebetween to secure said roller therein;

said roller, said slider rail cap, and said glazing bead cooperatively forming said bottom slider sash rail of said sliding window.

26. The low profile window as recited in claim 25 wherein, said sash inserts include said glazing bead and a sash interlock to form inner slider sash stiles;

said sash interlock cross-section of a generally planar body having a plurality of protruding fingers and an opposing weather strip pocket including an interlocking means attached to said weather strip pocket such that when at least two sashes are in the closed position, two interlock means overlap to form a weather tight seal between said sashes.

27. The low profile window as recited in claim 1 wherein, said side jambs, said head, and said bottom sill are formed of a common master frame and window frame inserts that snap into said common master frame, said master frame in cross-section including three equally spaced parallel slider walls of equivalent length, said slider walls interconnected by two spaced cross pieces, first cross piece extending perpendicularly and intermediate the ends between said slider walls and second cross piece angled between said slider walls, said outward slider wall having an L-shaped extension projecting from an end thereof to form a screen truck.

28. The low profile window as recited in claim 1, wherein said window frame inserts include at least two sash stops, two screen track adapters, and at least two balance covers;

said sash stops, said screen track adapters, and said balance covers in cooperation with said master frame form said two parallel side jambs of said window frame.

29. The low profile window as recited in claim 1, wherein said window frame inserts include a sill insert, and a bulb seal insert;

said bulb seal insert in cooperation with said sill insert and said master frame form said bottom sill of said window frame.

30. The low profile window as recited in claim 1, wherein said sash inserts include glazing beads;

said glazing beads in cooperation with said master sash form said two first sash stiles of said first sash.

31. Thw low profile window as recited in claim 1, wherein said sash inserts include a top rail cap, and a glazing bead;

said top rail cap and said glazing bead in cooperation with said master sash form said first top rail fo said first sash.

32. The low profile window as recited in claim 1, wherein said sash inserts include a sash interlock, and a glasing bead;

said sash interlock and said glazing bead in cooperation with said master sash form said first bottom sash rail of said upper sash.

33. The low profile window as recited in claim 1, wherein said sash inserts include at least two glazing beads, and at least two side rail extenders;

said glazing beads and said side rail extenders in cooperation with said master sash form said second sash stiles of said second sash.

34. The low profile window as recited in claim 1, wherein said sash inserts include a sash interlock and a glazing bead;

said sash interlock and said glazing bead in cooperation with said master sash form said second top rail of said second sash.

35. The low profile as recited in claim 1 wherein said sash inserts include a glazing bead, and a bottom rail cap;

said glazing bead and said bottom rail cap in cooperation with said master sash form said second bottom sash rail of said second sash.

* * * * *

UNITED STATES PATENT AND TRADEMARK OFFICE

CERTIFICATE OF CORRECTION

PATENT NO. : 4,944,118

DATED : July 31, 1990

INVENTOR(S) : Alexander J. Biro

It is certified that error appears in the above-identified patent and that said Letters Patent is hereby corrected as shown below:

Column 18 Line 15 "180" should read --188--.

Claim 1 (b) Line 20 Column 20 "welding" should read --welded--.

Claim 27 Line 8 Column 24 "truck" should read --track--.

Claim 31 Line 32 Column 24 "fo" should read --of--.

Claim 32 Line 36 Column 24 "glasing" should read --glazing--.

Claim 35 Line 52 Column 24 after "profile" insert --window--.

Signed and Sealed this

Seventh Day of January, 1992

*Attest:*

HARRY F. MANBECK, JR.

*Attesting Officer*

*Commissioner of Patents and Trademarks*